US006595626B2

(12) United States Patent
Kudo et al.

(10) Patent No.: US 6,595,626 B2
(45) Date of Patent: Jul. 22, 2003

(54) LIQUID EJECTING HEAD, LIQUID EJECTING DEVICE AND LIQUID EJECTING METHOD

(75) Inventors: Kiyomitsu Kudo, Kanagawa-ken (JP); Hiroshi Sugitani, Tokyo (JP); Masami Ikeda, Kanagawa-ken (JP); Makiko Kimura, Kanagawa-ken (JP); Toshio Kashino, Kanagawa-ken (JP); Takeshi Okazaki, Kanagawa-ken (JP); Aya Yoshihira, Kanagawa-ken (JP); Yoshie Nakata, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/880,758

(22) Filed: Jun. 15, 2001

(65) Prior Publication Data

US 2001/0048455 A1 Dec. 6, 2001

Related U.S. Application Data

(62) Division of application No. 08/586,260, filed on Jan. 16, 1996, now Pat. No. 6,334,669.

(30) Foreign Application Priority Data

Jan. 13, 1995 (JP) ..... 95-004109
May 26, 1995 (JP) ..... 95-128448

(51) Int. Cl.[7] ..... B41J 2/05; B41J 2/04; B41J 2/06; B41J 2/015

(52) U.S. Cl. ..... 347/65; 347/61; 347/56; 347/54; 347/55; 347/20

(58) Field of Search ..... 347/65, 56, 54, 347/55, 19, 23, 66, 20

(56) References Cited

U.S. PATENT DOCUMENTS 4,412,224 A 10/1983 Sugitani ..... 346/1.1
4,417,251 A 11/1983 Sugitani ..... 346/1.1

(List continued on next page.)

FOREIGN PATENT DOCUMENTS

| | | |
|---|---|---|
| EP | 0 436 047 A1 | 7/1991 |
| EP | 04 437 98 A2 | 8/1991 |
| EP | 0 504 879 A1 | 9/1992 |
| JP | 55-81172 | 6/1980 |
| JP | 61-69467 | 4/1986 |
| JP | 61-110557 | 5/1986 |
| JP | 62-110557 | 5/1986 |
| JP | 62-222854 | 9/1987 |
| JP | 63-028654 | 2/1988 |
| JP | 63-197652 | 8/1988 |
| JP | 3-81155 | 4/1991 |
| JP | 04-185447 | 7/1992 |
| JP | 5-124189 | 5/1993 |
| JP | 6-87214 | 3/1994 |
| JP | 63-199972 | 8/1998 |

*Primary Examiner*—Raquel Yvette Gordon
*Assistant Examiner*—Charles W. Stewart, Jr.
(74) *Attorney, Agent, or Firm*—Fitzpatrick, Cella, Harper & Scinto

(57) ABSTRACT

A liquid ejecting head for ejecting liquid by generation of bubble includes an ejection outlet for ejecting the liquid; a liquid path in fluid communication with the ejection outlet; a bubble generation region for generating the bubble in the liquid; a movable member having a fulcrum and a free end and disposed faced to the bubble generation region; wherein the movable member moves from the first position to the second position by pressure produced by the generation of the bubble, and a resistance against movement of the movable member, is smaller adjacent the free end than adjacent the fulcrum.

13 Claims, 19 Drawing Sheets

U.S. PATENT DOCUMENTS

| | | | | |
|---|---|---|---|---|
| 4,437,100 | A | 3/1984 | Sugitani et al. | 346/1.1 |
| 4,450,455 | A | 5/1984 | Sugitani et al. | 346/140 R |
| 4,480,259 | A | 10/1984 | Kruger et al. | 346/140 R |
| 4,487,662 | A | 12/1984 | Fischbeck | 204/15 |
| 4,496,960 | A | 1/1985 | Fischbeck | 346/140 R |
| 4,509,063 | A | 4/1985 | Sugitani et al. | 346/140 R |
| 4,521,787 | A | 6/1985 | Yokota et al. | 346/140 R |
| 4,558,333 | A | 12/1985 | Sugitani et al. | 346/140 R |
| 4,568,953 | A | 2/1986 | Aoki et al. | 346/140 R |
| 4,609,427 | A | 9/1986 | Inamoto et al. | 156/633 |
| 4,611,219 | A | 9/1986 | Sugitani et al. | 346/140 R |
| 4,646,120 | A | 2/1987 | Hacskaylo | 346/140 R |
| 4,666,823 | A | 5/1987 | Yokota et al. | 430/320 |
| 4,723,129 | A | 2/1988 | Endo et al. | 346/1.1 |
| 4,994,825 | A | 2/1991 | Saito et al. | 346/140 R |
| 5,095,321 | A | 3/1992 | Saito et al. | 346/140 R |
| 5,208,604 | A | 5/1993 | Watanabe et al. | 346/1.1 |
| 5,262,802 | A | 11/1993 | Karita et al. | 346/140 R |
| 5,278,585 | A | 1/1994 | Karz et al. | 346/140 R |
| 5,389,957 | A | 2/1995 | Kimura et al. | 347/20 |
| 5,485,184 | A | 1/1996 | Nakagomi et al. | 347/63 |
| 6,334,669 | B1 * | 1/2002 | Kudo et al. | 347/65 |

* cited by examiner (a)

(b)

LIQUID EJECTING HEAD, LIQUID EJECTING DEVICE AND LIQUID EJECTING METHOD

This application is a divisional of application Ser. No. 08/586,260, filed Jan. 16, 1996 and issued as U.S. Pat. No. 6,334,669 on Jan. 1, 2002.

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such election outlets can be posited at high density, and therefore, small size recording apparatus capable of providing a high resolution can be provided, and color images can be easily formed. Therefore, the bubble let recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 propose flow passage structures as disclosed in FIG. 1, (*a*) and (*b*), for example.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When the valve is generated in the path 3, the suppression of the back wave is not practically significant. The back wave is not directly contributable to the election of the liquid. Upon the back wave occurs in the path, the pressure for directly ejecting the liquid already makes the liquid electable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467. Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the election force are deteriorated although the some effect is provided by the provision between the ejection liquid and the bubble generation liquid.

SUMMARY OF THE INVENTION

Accordingly, it is a principal object of the present invention to provide a structure for a movable member in a liquid ejection using the movable member.

It is another object of the present invention to provide a liquid ejection principle with which the generated bubble is controlled in a novel manner.

It is a further object of the present invention to provide a liquid ejecting method, liquid ejecting head and so on wherein heat accumulation in the liquid on the heat generating element is significantly reduced, and the residual bubble on the heat generating element is reduced, while improving the ejection efficiency and the ejection pressure.

It is a further object of the present invention to provide a liquid ejecting head and so on wherein inertia force in a direction against liquid supply direction due to back wave is suppressed, and simultaneously, a degree of retraction of a meniscus is reduction by a valve function of a movable member by which the refilling frequency is increased, thus permitting high speed printing.

It is a further object of the present invention to provide a liquid electing head and so on wherein deposition of residual material on the heat generating element is reduced, and the range of the usable liquid is widened, and in addition, the ejection efficiency and the ejection force are significantly increased.

It is a further object of the present invention to provide a liquid ejection method and a liquid ejection head, wherein excessive vibration is regulated within a desired range, and the durability of the movable member is improved.

It is a further object of the present invention to provide a liquid ejecting method, a liquid ejecting head and so on, wherein the choice of the liquid to be ejected is made greater.

It is a further object of the present invention to provide a head kit for permitting easy refuse of the liquid ejecting head.

According to an aspect of the present invention, there is provided a liquid ejecting head for ejecting liquid by generation of bubble, comprising: an ejection outlet for ejecting the liquid; a liquid path in fluid communication with the ejection outlet; a bubble generation region for generating the bubble in the liquid; a movable member having a fulcrum and a free end and disposed faced to the bubble generation region; wherein the movable member moves from the first position to the second position by pressure produced by the generation of the bubble, and a resistance against movement of the movable member, is smaller adjacent the free end than adjacent the fulcrum.

According to another aspect of the present invention, there is provided a liquid ejecting head for ejecting liquid by generation of bubble, comprising: an ejection outlet for ejecting the liquid; a liquid path in fluid communication with the ejection outlet; a bubble generation region for generating the bubble in the liquid; a movable member having a fulcrum and a free end and disposed faced to the bubble generation region; wherein the movable member moves from the first position to the second position by pressure produced by the generation of the bubble, and a height of the flow path is higher above the free end than above the fulcrum end.

According to a further aspect of the present invention, there is provided a liquid ejecting head for ejecting liquid by generation of bubble, comprising: an ejection outlet for ejecting the liquid; a liquid path in fluid communication with the ejection outlet; a bubble generation region for generating the bubble in the liquid; a movable member having a fulcrum and a free end and disposed faced to the bubble generation region; wherein the movable member moves from the first position to the second position by pressure produced by the generation of the bubble, and a height of the flow path is lower at least in a portion between a position of the free end and a position of the fulcrum than at the position of the free end.

According to a further aspect of the present invention, there is provided a liquid ejecting head for ejecting liquid by generation of bubble, comprising: a first liquid flow path in fluid communication with an election outlet; a second liquid flow path having bubble generation region for generating the bubble in the liquid by applying heat to the liquid; a movable member disposed between the first liquid flow path and the bubble generation region and having a free end adjacent the election outlet, wherein the free end of the movable member is displaced into the first liquid flow path by pressure produced by the generation of the bubble, thus guiding the pressure toward the election outlet of the first liquid flow path by the movement of the movable member to elect the liquid, wherein a height of the flow path is higher above the free end than above the fulcrum end.

According to a further aspect of the present invention, there is provided a liquid ejecting head for electing liquid by generation of bubble, comprising: a first liquid flow path in fluid communication with an election outlet; a second liquid flow path having bubble generation region for generating the bubble in the liquid by applying heat to the liquid; a movable member disposed between the first liquid flow path and the bubble generation region and having a free end adjacent the election outlet, wherein the free end of the movable member is displaced into the first liquid flow path by pressure produced by the generation of the bubble, thus guiding the pressure toward the election outlet of the first liquid flow path by the movement of the movable member to eject the liquid, wherein a height of the flow path is lower at least in a portion between a position of the free end and a position of the fulcrum than at the position of the free end.

According to a further aspect of the present invention, there is provided a liquid electing method for ejecting liquid by generation of a bubble, comprising: preparing a head comprising an ejection outlet for electing the liquid, a bubble generation region for generating the bubble in the liquid, a movable member having a free end and a fulcrum and disposed faced to the bubble generation region, displacing the movable member by pressure produced by the generation of the bubble in the bubble generating portion, wherein a resistance against movement of the movable member, is smaller adjacent the free end than adjacent the fulcrum.

According to a further aspect of the present invention, there is provided a liquid electing method for electing liquid by generation of a bubble, comprising: preparing a head including a first liquid flow path in fluid communication with a liquid ejection outlet, a second liquid flow path having a bubble generation region and a movable member disposed between the first liquid flow path and the bubble generation region and having a free end adjacent the ejection outlet side; and generating a bubble in the bubble generation region to displace the free end of the movable member into the first liquid flow path by pressure produced by the generation of the bubble, thus guiding the pressure toward the election outlet of the first liquid flow path by the movement of the movable member to elect the liquid, wherein a resistance against movement of the movable member, is smaller adjacent the free end than adjacent the fulcrum.

According to a further aspect of the present invention, there is provided a liquid election recording method for ejecting recording liquid by generation of a bubble to effect recording, comprising: preparing a head comprising an election outlet for electing the recording liquid, a bubble generation region for generating the bubble in the liquid, a movable member having a free end and a fulcrum and disposed faced to the bubble generation region; displacing the movable member by pressure produced by the generation of the bubble in the bubble generating portion, wherein a resistance the liquid, against movement of the movable member, is smaller adjacent the free end than adjacent the fulcrum.

According to a further aspect of the present invention there is provided a head cartridge comprising: a liquid electing head as defined above; and a liquid container for containing the liquid to be supplied to the liquid electing head.

According to a further aspect of the present invention there is provided a liquid ejecting apparatus for ejecting recording liquid by generation of a bubble, comprising: a liquid ejecting head as defined above; and driving signal supply means for supplying a driving signal for ejecting the liquid through the liquid ejecting head.

According to a further aspect of the present invention there is provided a liquid electing apparatus for ejecting recording liquid by generation of a bubble, comprising: a liquid ejecting head as defined above; and recording material transporting means for feeding a recording material for receiving the liquid elected from the liquid ejecting head.

According to a further aspect of the present invention there is provided a recording system comprising: a liquid ejecting apparatus as defined above; and a pre-processing or post-processing means for promoting fixing of the liquid on the recording material after the recording.

According to a further aspect of the present invention there is provided a head kit comprising: a liquid electing head as defined above; and a liquid container containing the liquid to be supplied to the liquid electing head.

According to a further aspect of the present invention there is provided a head kit comprising: a liquid ejecting head as defined above; a liquid container for containing the liquid to be supplied to the liquid electing head; and liquid filling means for filling the liquid into the liquid container.

According to a further aspect of the present invention there is provided a recorded material characterized by being recorded by ejected ink through a liquid ejection recording method as defined above.

According to the present invention, the object of which is to provide the structure described above, it was possible to prevent the free end of the moving member from moving into the bubble generation region (toward the heat generating member) far beyond the first position; therefore, the durability of the moving member could be improved.

In this embodiment, the height of liquid flow path is higher right above the free end than right above the fulcrum of the movable member, or it is lower at least a part between a position faced to the free end and a position faced to the fulcrum than at the position faced to the free end. By this, the resistance, by the liquid itself or by the structure of the flow passage, against the motion of the movable member is smaller adjacent the free end of the movable member than adjacent the fulcrum, by which the ejection state of the liquid is stabilized, and the ejection force can be increased.

With the liquid ejecting method and the head using the novel ejection principle, a synergistic effect is provided by the generated bubble and the movable member moved thereby so that the liquid adjacent the ejection outlet can be ejection with high efficiency, and therefore, the ejection efficiency is improved. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. Even if the election failure occurs, the normal operation is recovered by a small scale recovery process including a preliminary ejection and sucking recovery.

In an aspect of improving the refilling property, the responsivity, the stabilized growth of the bubble and stabilization of the liquid droplet during the continuous ejections are accomplished, thus permitting high speed recording.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

The free end portion or region of the movable member may mean the free end edge at the downstream side of the movable member or may mean the free end edge and the lateral edges adjacent the free end.

The resistance edgiest the motion of the movable member means the resistance due to the liquid itself or the structure of the liquid passage when the movable member moves away from the bubble generation region by the generation of the bubble. The resistance may be reduced by providing a resistance inclination, using a resistance by physical stopper, using a resistance of virtual stopper with the use of fluid. The resistance is called herein after resistance or flow resistance.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Embodiment 1

Referring to the accompanying drawings, the embodiments of the present invention will be described.

Figure 1:
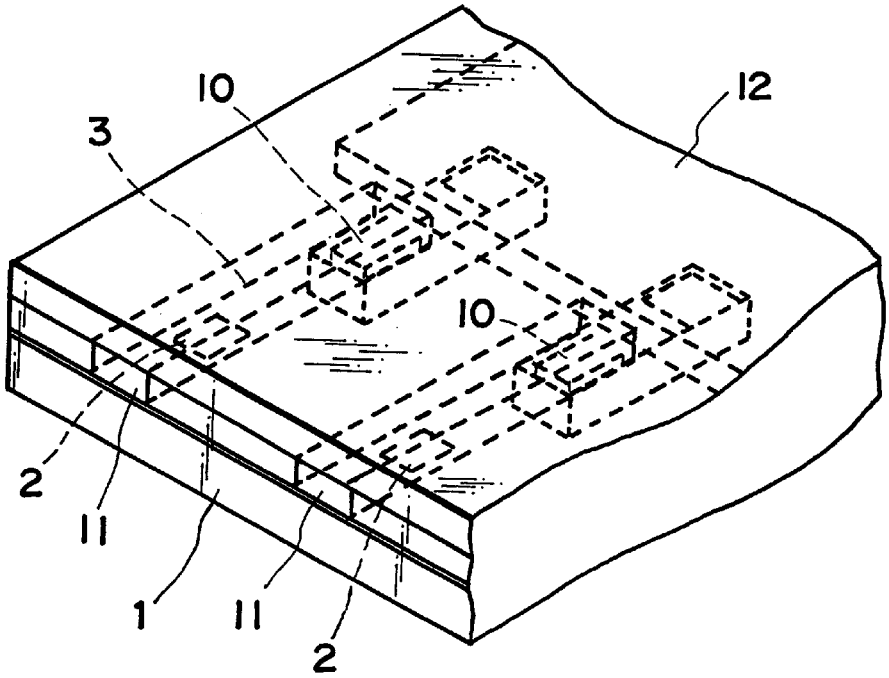
FIG. 1 is a sectional view of a liquid flow path of a conventional liquid ejecting head.
Figure 1:
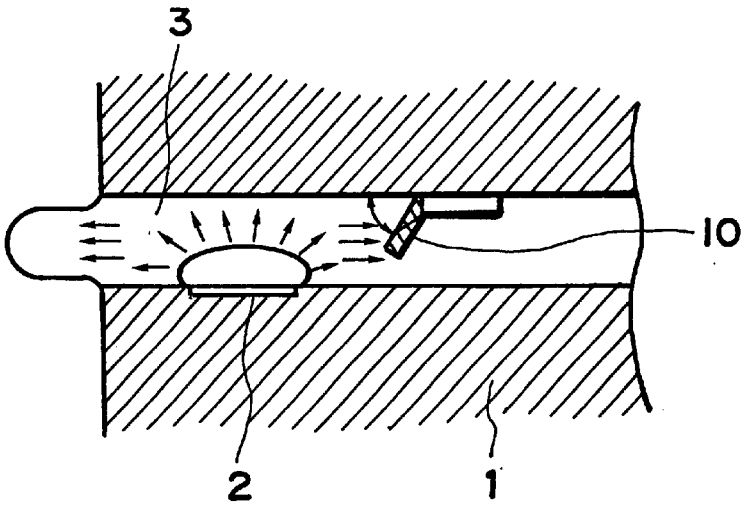
Figure 2:
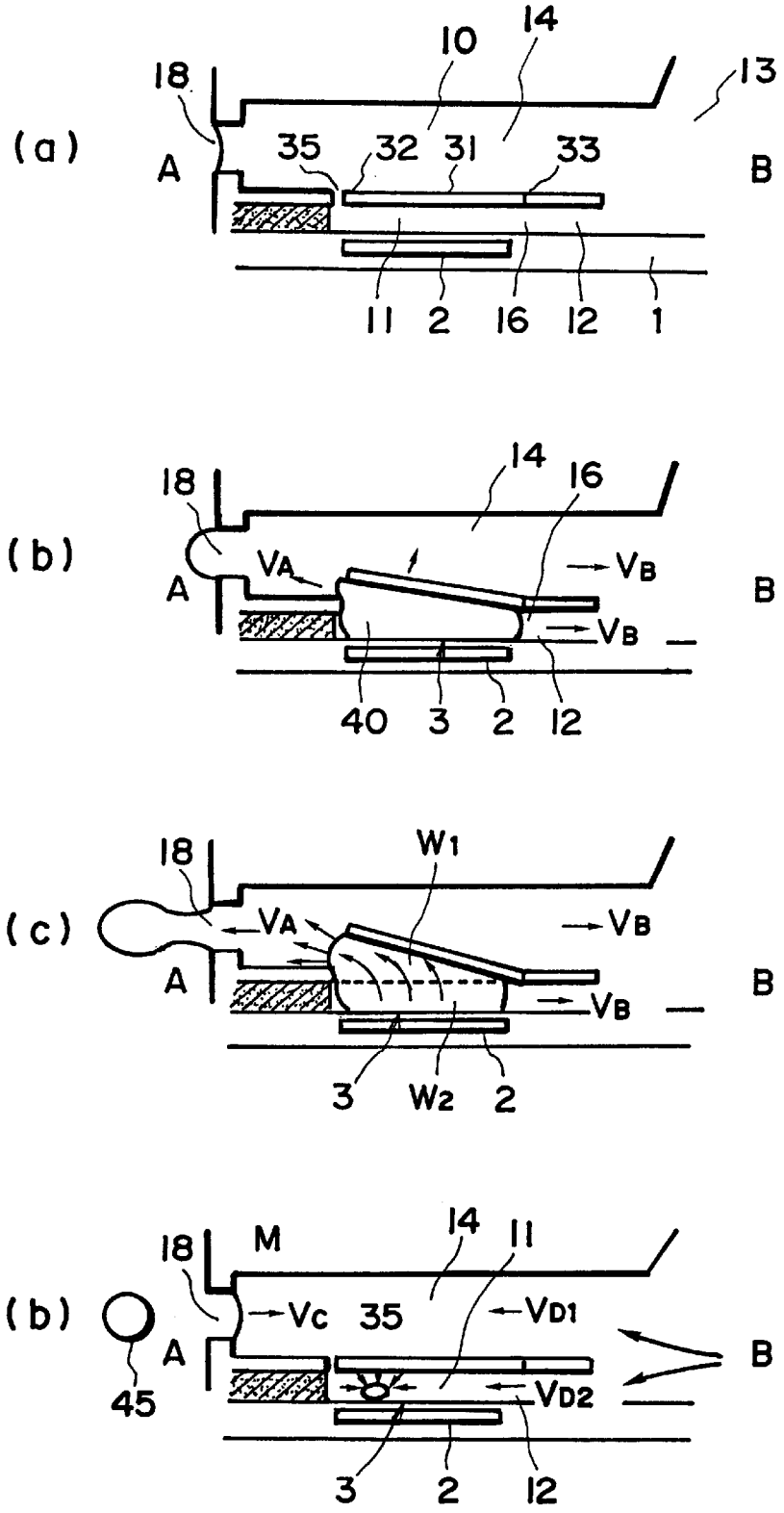
FIG. 2 is a schematic sectional view of example of a liquid ejecting head of an embodiment of the present invention.
Figure 3:
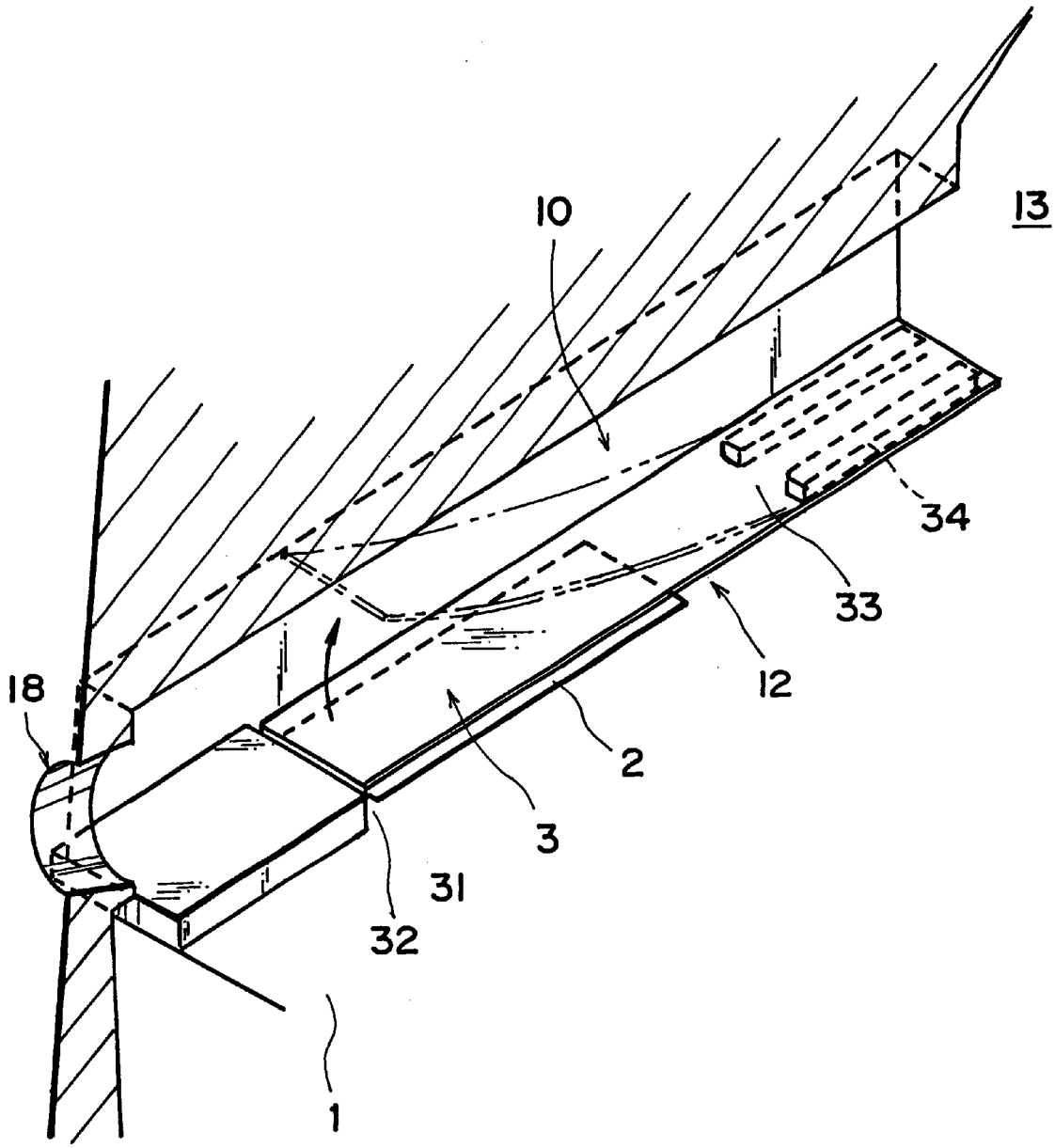
FIG. 3 is a partly broken perspective view of a liquid ejecting head according to an embodiment of the present invention.

In this embodiment, the description will be made as to an improvement in an ejection force and/or an ejection efficiency by controlling a direction of propagation of pressure resulting from generation of a bubble for ejecting the-liquid and controlling a direction of growth of the bubble, usable with this embodiment. FIG. 2 is a schematic sectional view of a liquid ejecting head taken along a liquid flow path usable with this embodiment, and FIG. 3 is a partly broken perspective view of the liquid ejecting head.

The liquid ejecting head of this embodiment comprises a heat generating element 2 (a heat generating resistor of 40 $\mu$m×105 $\mu$m in this embodiment) as the ejection energy generating element for supplying thermal energy to the liquid to elect the liquid, an element substrate 1 on which said heat generating element 2 is provided and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the election outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the election outlet 18 through the movable member 31 caused by the ejecting operation and that it has a free end (free end portion) 32 in a downstream side of the fulcrum 33, the movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the election outlet side about the fulcrum 33, as shown in FIG. 2, (*b*) and (*c*) or in FIG. 3. By the displacement of the movable member 31 or the state after the displacement, the propagation of the pressure caused by the generation of the bubble and the growth of the bubble per se are directed toward the ejection outlet.

Here, one of the fundamental election principles used with the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 4:
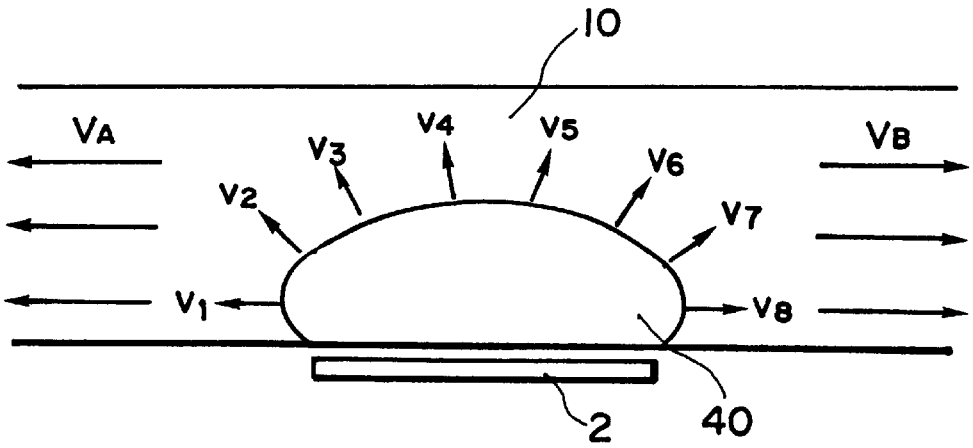
FIG. 4 is a schematic view of pressure propagation from a bubble in a conventional head.
Figure 5:
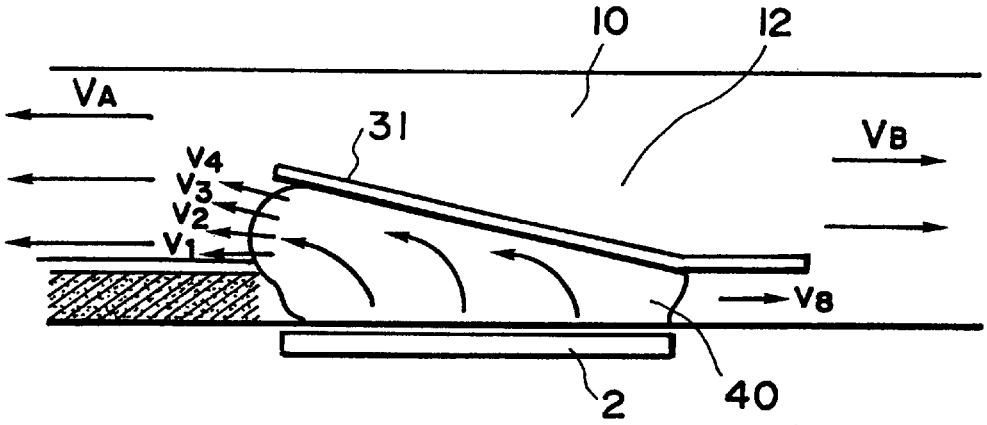
FIG. 5 is a schematic view of pressure propagation from a bubble in a head according to an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection, this portion is important since it directly contributable to the liquid election efficiency, the liquid election pressure and the ejection speed. Furthermore, the component V1 is closest to the direction of $V_A$ which is the election direction, and therefore, is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions, thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 2, the ejecting operation of the liquid ejecting head in this example will be described in detail.

FIG. 2, (*a*) shows a state before the energy such as electric energy is applied to the heat generating element 2, and therefore, no heat has vet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 2, (*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet, it should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 2, (*c*) shows a state in which the bubble 40 has further grown, by the pressure resulting from the bubble 40 generation, the movable member 31 is displaced further. The generated bubble grows more downstream than upstream, and it expands greatly beyond a first position (broken line position) of the movable member.

As the movable member 31 gradually moves in response to the growth of the bubble 40 as described above, the bubble 40 is controlled so that it grows in the direction in which the pressure generated by the bubble 40 can easily escape or be released, and in which the bubble 40 easily shifts in volumetric terms. In other words, the growth of the bubble is uniformly directed toward the free end of the movable member. This also is thought to contribute to the improvement of the ejection efficiency.

Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the election outlet, it hardly obstructs propagation and growth, and can efficiently control the propagation direction of the pressure and the growth direction of the bubble in accordance with the degree of the pressure.

FIG. 2, (*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid, now, the description will be made as to the refilling of the liquid in the liquid ejecting head usable with the present invention.

Referring to FIG. 2, liquid supply mechanism will be described.

When the bubble 40 enters the bubble collapsing process after the maximum volume thereof after FIG. 2, (*c*) state, a volume of the liquid enough to compensate for the collapsing bubbling volume flows into the bubble generation region from the election outlet 18 side of the first liquid flow oath 14 and from the bubble generation region of the second liquid flow path 16.

In the case of conventional liquid flow passage structure not having the movable member 31, the amount of the liquid from the ejection outlet side to the bubble collapse position and the amount of the liquid from the common liquid chamber thereinto, are attributable to the flow resistances of the portion closer to the ejection outlet than the bubble generation region and the portion closer to the common liquid chamber.

Therefore, when the flow resistance at the supply port side is smaller than the other side, a large amount of the liquid flows into the bubble collapse position from the election outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality, however, according to this embodiment, the flows of the liquid in the first liquid flow path 14 at the ejection outlet side and the election outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration, therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2, then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 6:
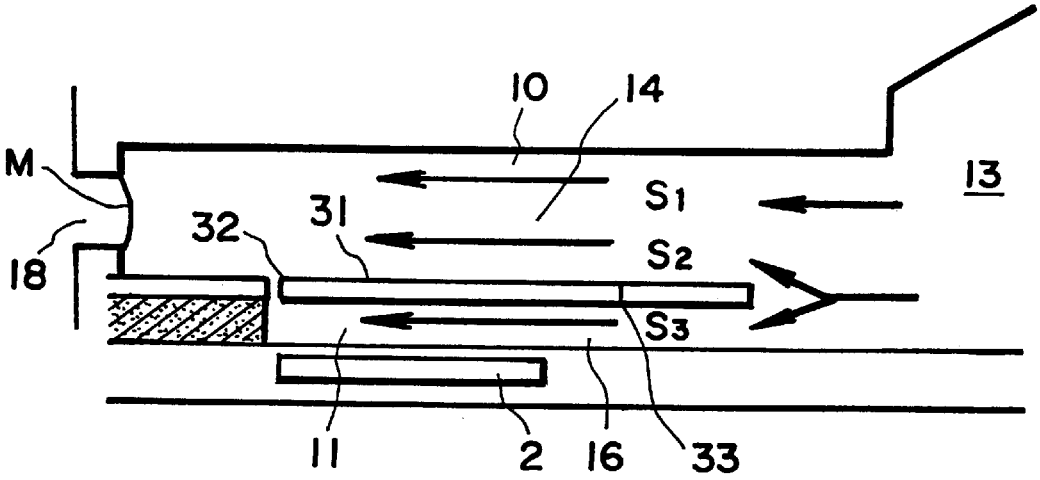
FIG. 6 is a schematic view of a liquid flow in an embodiment of the present invention.

The positional relation between the free end 32 and the fulcrum 33 of the movable member 31 is such that the free end is at a downstream position of the fulcrum as indicated by 6 in the Figure, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 6, returns to the election outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Embodiment 1

In the following the description will be made with an example wherein a first liquid path and a second liquid path are separated by a separation or partition wall. However, the present invention is applicable to the example described in the foregoing.

Figure 7:
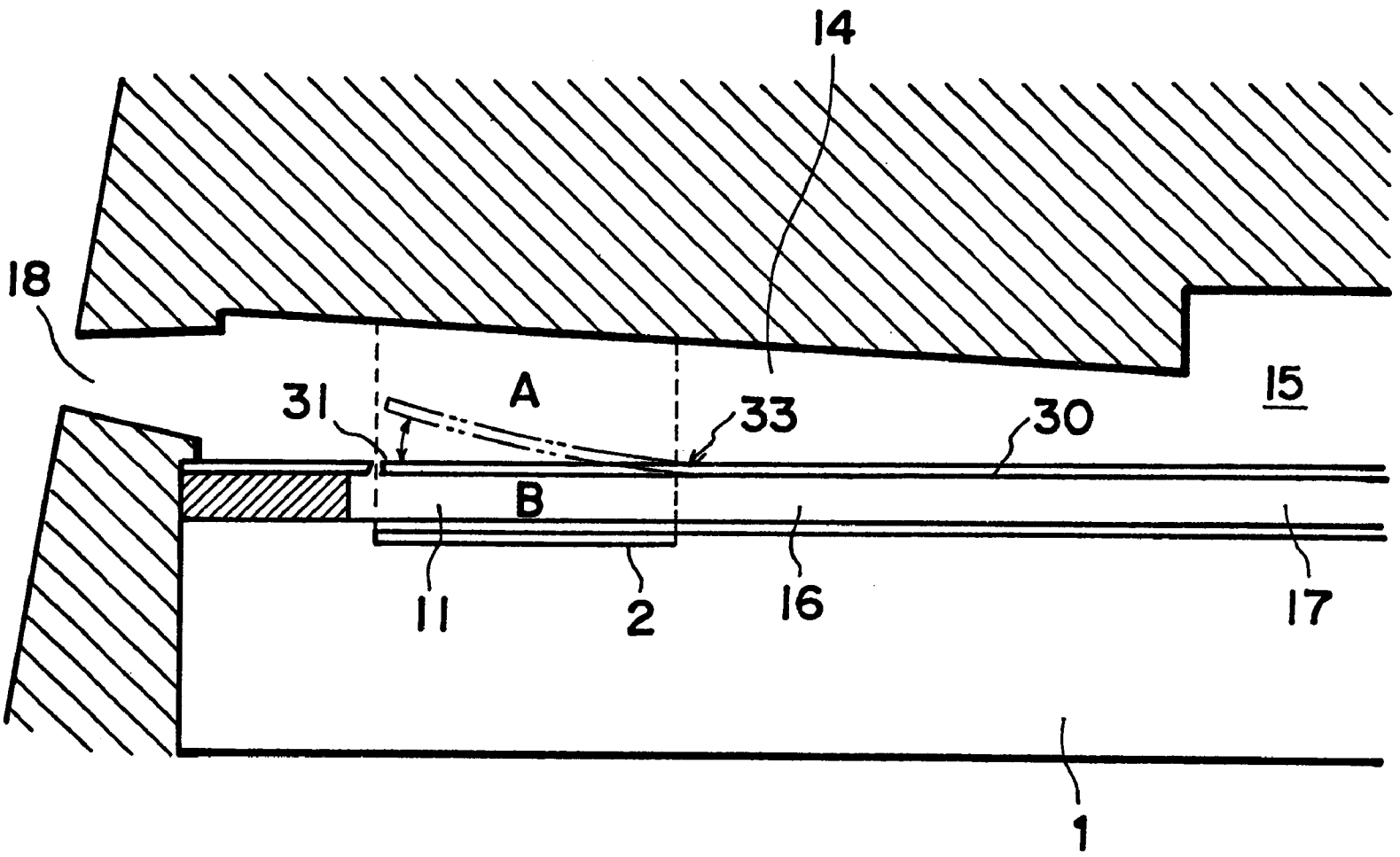
FIG. 7 is a sectional view of a liquid ejecting head (2 flow path) according to Embodiment 1 of the present invention.

FIG. 7 shows a first embodiment. In FIG. 7, A shows an upwardly displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

The structure of the first path is such that the height thereof gradually increases toward the ejection outlet to permit easier motion of the free end that the fulcrum side.

In the case that the bubble generation liquid and election liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall, however, when the mixing to a certain extent is permissible, the complete isolation is not inevitable.

A portion of the partition wall in the upward projection space of the heat generating element (ejection pressure generation region including A and B (bubble generation region 11) in FIG. 7), is in the form of a cantilever movable member 31, formed by slits 35, having a fulcrum 33 at the common liquid chamber (15 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). Thus, since the free end portion is more easily movable, the bubble is directed to the ejection outlet without waste. A partition wall 30 is disposed, with a space for constituting a second liquid flow path, above an element substrate 1 provided with a heat generating resistor portion as the heat generating element 2 and wiring electrodes (not shown) for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2, the relation between the second liquid flow path 16 and the heat generating element 2 is the same in this embodiment.

Embodiment 2

Figure 8:
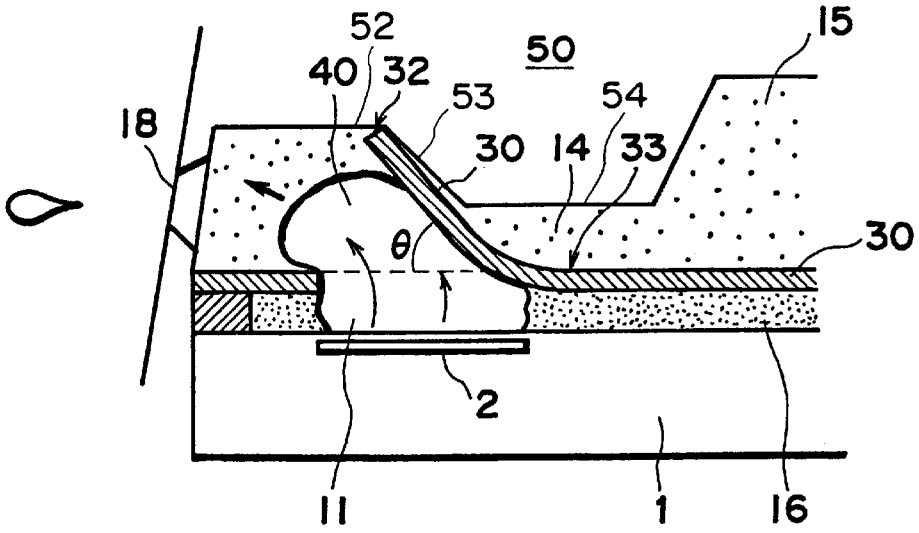
FIG. 8 is an illustration of a stopper structure for the second liquid flow path edgiest the movable member according to a second embodiment.
Figure 9:
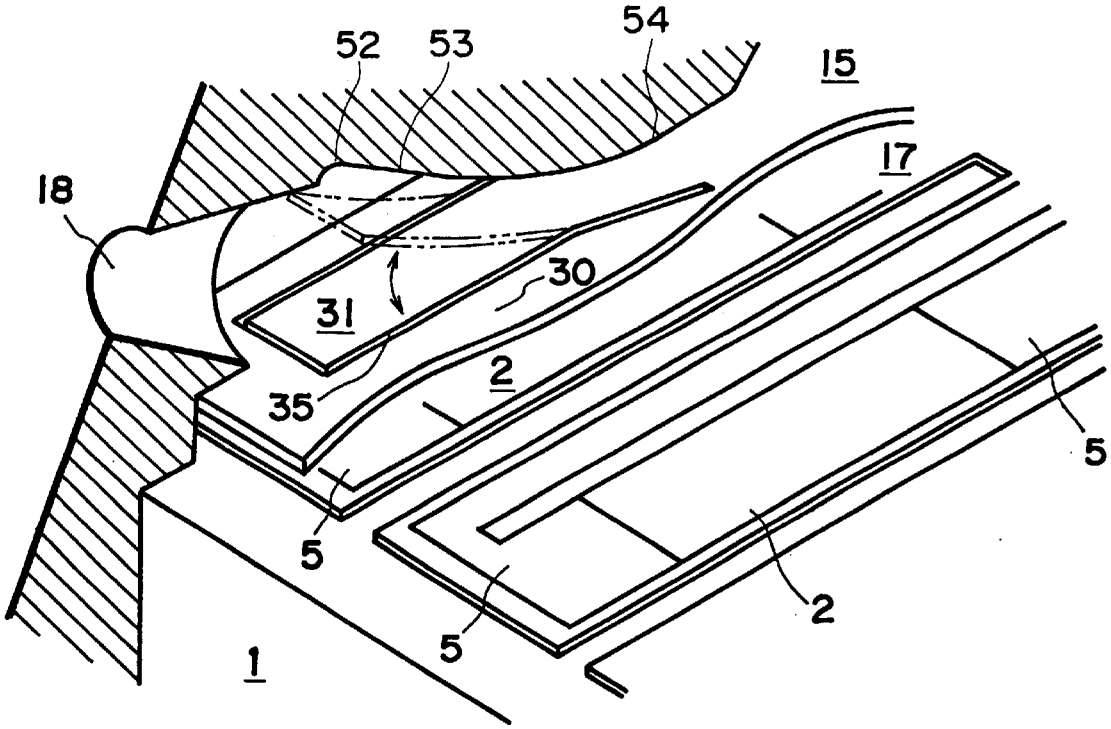
FIG. 9 is a portion partly broken perspective view of the liquid ejecting head in the portion of FIG. 8.

FIGS. 8 and 9 are a schematic longitudinal section of the essential portion of the liquid ejection head in this second embodiment, and a partially cutaway schematic view thereof, respectively. They depict one of the principal concepts of the present invention, and its characteristics.

FIG. 8 schematically illustrates the positioning of the movable member 31 in the liquid passage; the movable member 31 is disposed directly above the bubble generation region 11 of the second liquid passage 16. FIG. 9 is a partially cutaway perspective view of a liquid ejection head similar to the one illustrated in FIG. 8.

In this embodiment, the first liquid passage height varies depending on the location. It is greater directly above the free end of the movable member 31 than directly above the supporting portion of the movable member 31 or the adjacencies thereof; the first liquid passage ceiling portion 53 directly above the free end of the movable member 31 is higher than the first liquid passage ceiling portion directly above the supporting portion of the movable member 31 or the adjacencies thereof.

In other words, the configuration of the first liquid passage 16 is such that its resistance against the motion of the member is smaller near the free end 32 of the movable member 31 than near the supporting portion 33 of the movable member 31.

Therefore, the movement of the free end of the movable member 31 which moves due to the pressure from the bubble 40 generated in the bubble generation region 11 is not restricted. Consequently, the pressure from the bubble 40 is effectively transmitted toward the election orifice 18, and also, the growth of the bubble 40 is effectively directed toward the ejection orifice 18.

Further, the configuration of the first liquid passage 14 in this embodiment is such that its ceiling gradually is lower at least a part between a position faced to the free end and a position faced to the fulcrum than at the position faced to the free end.

Therefore, as the free end portion of the movable member 31 is moved close to the slanted portion 53 of the ceiling, that is, as the free end portion of the movable member 31 comes closer to the ceiling portion 54 above the supporting portion, which is lower than the ceiling portion on the free end side, the flow resistance between the movable member and the ceiling increases, regulating the movement of the movable member 31 toward the ceiling. Thus, even when there is a certain degree of non-uniformity among the movable members 31 due to manufacturing error, that is, even when the ejection characteristic varies due to the difference in the shade or material of the movable member 31, difference in the positional relationship between the movable member 31 and the bubble generation region 11, or the difference in the bubble generation caused by the heat generating member 2, the amount of the movable member displacement is rendered uniform by the ceiling configuration in this embodiment. As a result, the ejection is drastically stabilized.

Further, in the case of a head comprising plural passages for the liquid to be ejected, the structure in accordance with the present invention can further improve the uniformity in the ejection characteristic among the plural liquid passages. In particular, when it is known that the characteristic of the liquid passage is different at both side of the ejection head, the present invention may be applied only to these specific regions.

Further, even when non-uniform ejection occurs due to the instability in the bubble generation, or the like factors, as the ejection is repeated, the employment of the structure in accordance with the present invention can also stabilize the ejection characteristic.

As described above, in this embodiment, the resistance against the motion of the movable member by the liquid is rendered smaller on the side closer to the free end 32 of the movable member 31 than on the side closer to the supporting portion 33, that is, the resistance to the upward movement of the free end portion of the movable member is relatively smaller. Therefore, the ejection is reliably stabilized; the duration of the repeated election is remarkably uniform, and also, the election characteristic is rendered extremely uniform across the plural liquid passages. Thus, when the liquid election head in accordance with the present invention is employed as a recording head, the amount of image anomaly can be further reduced, drastically improving image quality.

In this embodiment, the flow resistance is reduced on the free end side compared to that on the supporting portion side, by modifying the ceiling structure of the first liquid passage. However, it may be reduced by other means such as modifying the structures of the lateral walls of the first liquid passage; for example, the portion with lower flow resistance may be created by making the liquid passage width greater than the movable member width, and the portion with higher flow resistance may be created by making the liquid passage width less than the movable member width.

Next, the other functions of the structure illustrated in FIG. 8, and the effects thereof, will be described.

The structure illustrated in FIG. 8 is such that when the movable member 31 is moved, it comes in contact with the ceiling of the first liquid passage, at least by a part of the free end portion 32 thereof. The provision of such a structure can stabilize the liquid ejection as described above, and also can reduce the mechanical damage of the movable member caused by the excessive movement of the movable member 31, improving the durability of the movable member 31.

Embodiment 3

Figure 10:
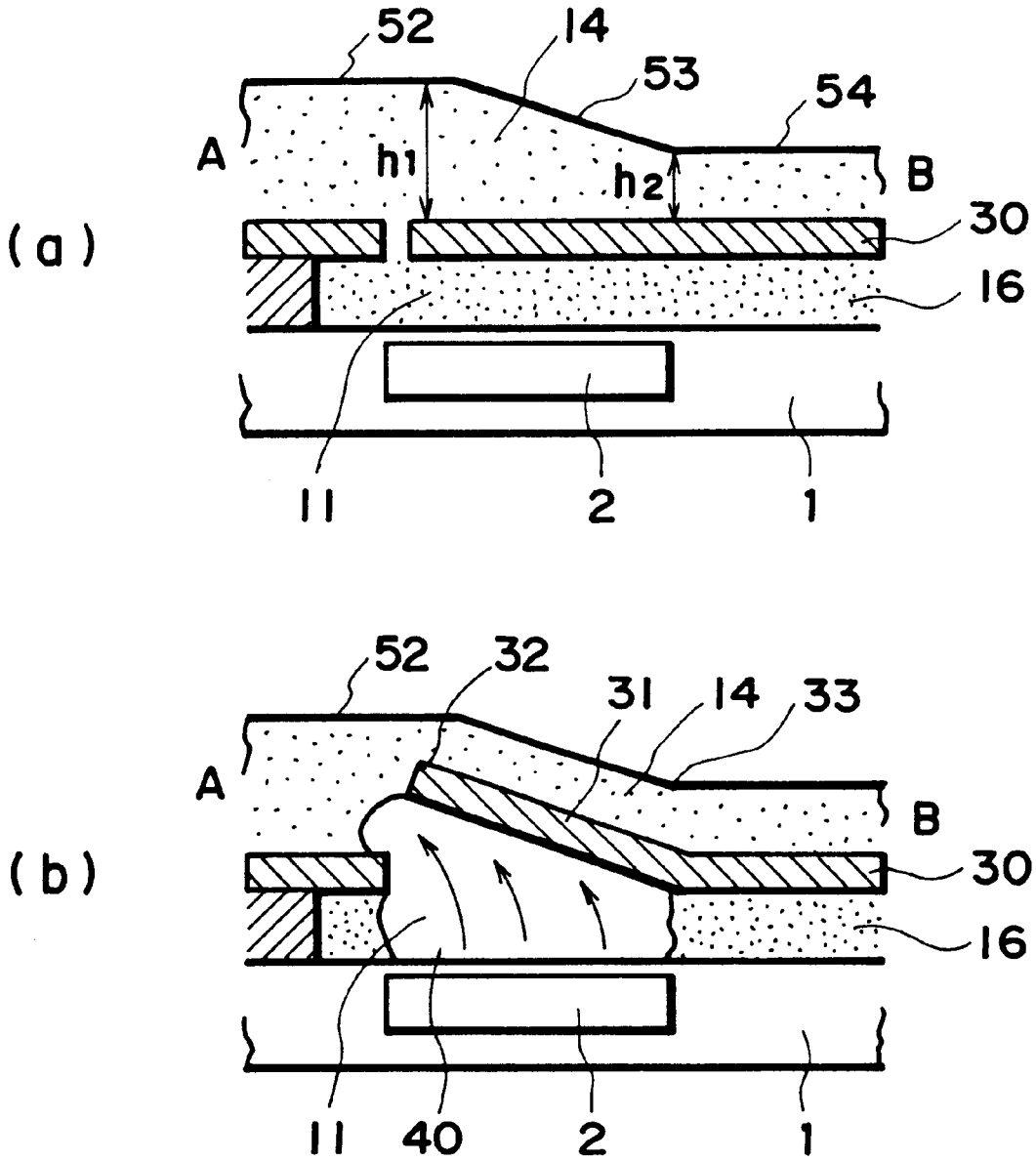
FIG. 10 is a longitudinal section of a liquid ejecting head according to a third embodiment of the present invention.

FIG. 10 is a schematic section of the essential portion of the liquid election head which offers the same effects as the preceding embodiment, and depicts the specific liquid passage structure thereof. The structure in this embodiment is basically the same as that illustrated in FIG. 8. However, in this embodiment, a ceiling height h1 on the free end side of the movable member 31 is greater than a ceiling height h2 on the supporting portion side of the movable member 31, and the ceiling section between the high and low sections forms a straight slope. With the presence of such a structure, the movement of the free end portion 32 of the movable member 31, which is caused by the growth of the bubble 40 as illustrated in FIG. 10, (*b*), becomes smoother, stabilizing thereby the election performance.

Modified Embodiment

Figure 11:
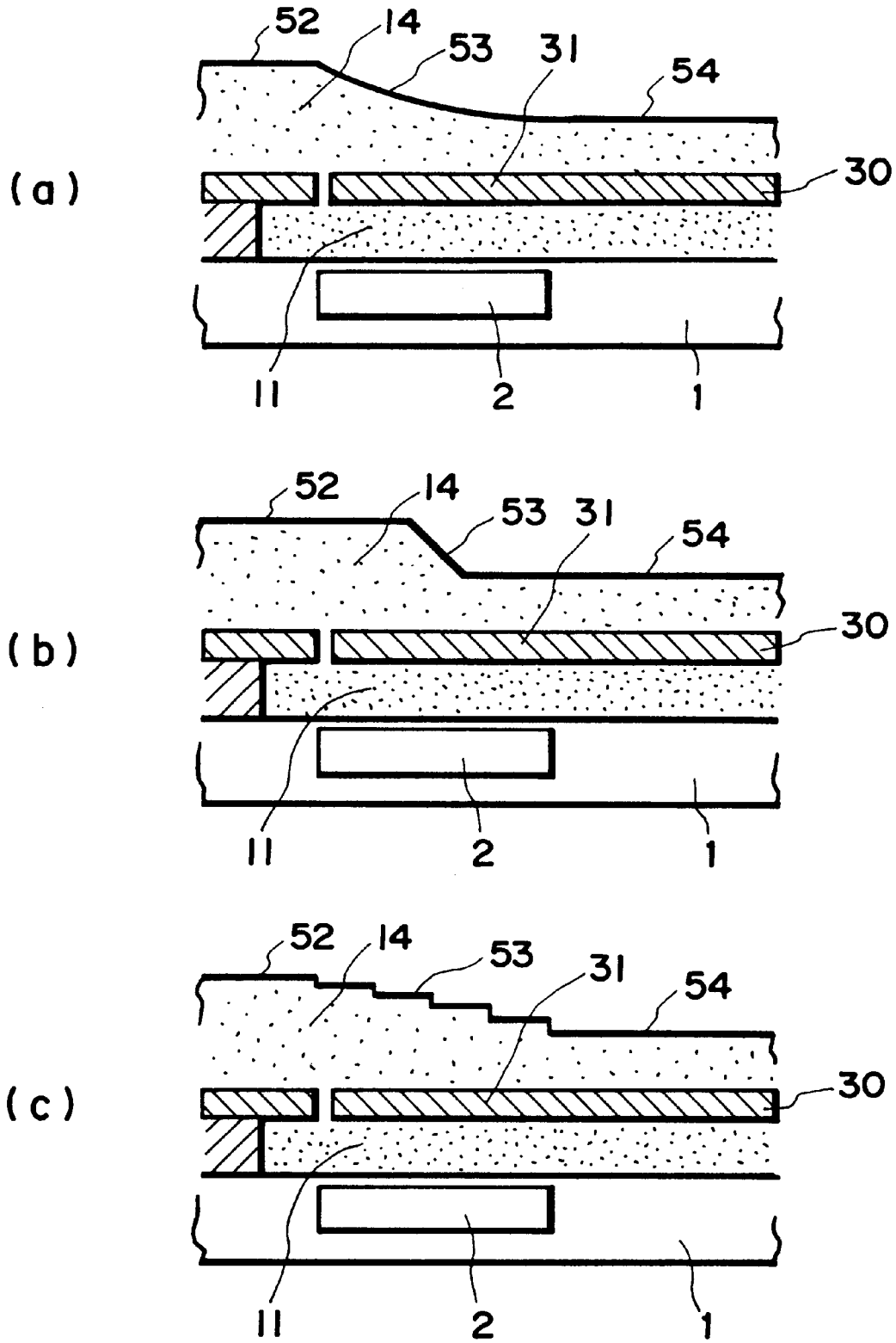
FIG. 11 is a longitudinal section of a liquid ejecting head according to a modified example of the third embodiment.

In this embodiment, the liquid passages, which are different in structure from those described above, but are the same in function, are described. FIGS. 11, (*a*), (*b*) and (*c*) illustrate such liquid passages.

Referring to FIG. 11, (*a*), the ceiling section between the ceiling section 52 on the free end side and the ceiling section 54 on the supporting portion side forms a convex slope, which descends from the free end side toward the supporting portion side.

This convex configuration of the sloped portion of the liquid passage ceiling is designed in order to allow the movable member to flex along the contour of the ceiling. With the presence of such a slope, even when the rigidity of the movable member 31 is relatively low, and therefore, the movable member 31 is bent, that is, the free end portion of the movable member 31 is bent further upward, the same effects as those descried above can be obtained. The sloped portion of the liquid passage ceiling may be rendered concave when the movable member 31 is such a member that deforms in the direction opposite to the direction described above.

FIG. 11, (*b*) depicts an example in which the angle of the slope portion illustrated in FIG. 10 is rendered steeper.

FIG. 11, (*c*) depicts an example in which the slanted portion of the liquid passage ceiling is stepped. This structure can be easily formed by etching the member to be grooved (member which constitutes the ceiling portion or the like of the first liquid passage), several times, therefore, it is easier to manufacture.

Embodiment 4

Next, referring to FIGS. 12, 13 and 14, the fourth embodiment of the present invention will be described. Since the basic structure in this embodiment is the same as those illustrated in FIGS. 10 and 11, the descriptions of the same portions will be omitted.

The structure in this embodiment is to drastically extend the service life of the movable member by aggressively modifying the structure described in the first embodiment in which the movable member is made to physically engage with, or contact, the ceiling of the first liquid passage to prevent the excessive displacement of the movable member 31.

Figure 12:
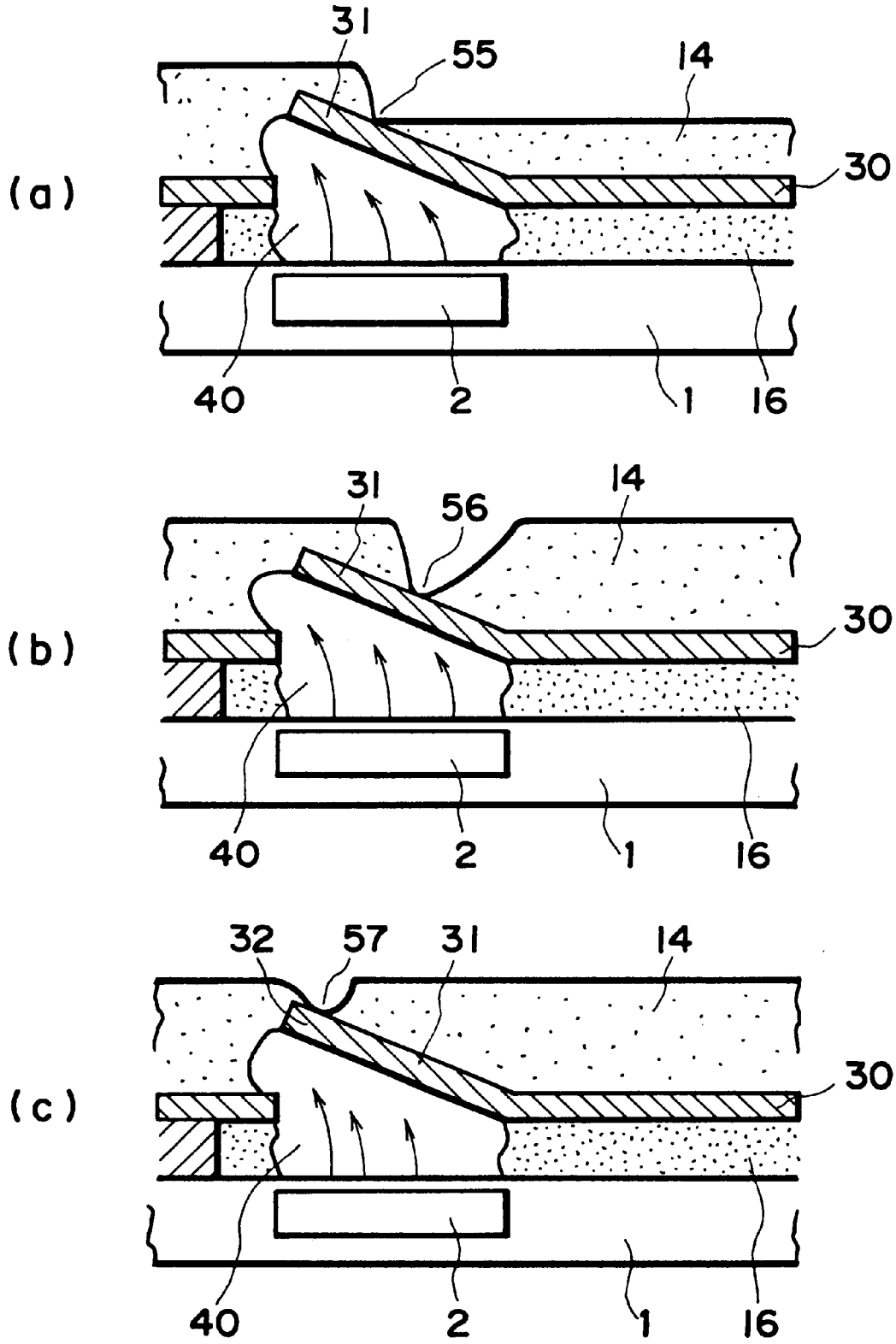
FIG. 12 is a longitudinal section of a liquid ejecting head according to a fourth embodiment of the present invention.

In the case of the modification illustrated in FIG. 12, (*a*), the flow resistance in the liquid passage is rendered smaller on the free end side than on the supporting member side, and the movable member is caused to engage with, or contact, the stepped portion 55 of the ceiling. Thus, the election characteristic is rendered uniform, and also, the excessive movement of the movable member 31 is prevented, improving its durability.

In the case of the modification illustrated in FIG. 12, (*b*), a projection 56 projects into the first liquid passage 14 from the liquid passage wall 22, and therefore, as the movable member is moved, it becomes engaged with, or comes in contact with, this projection 56, being thereby prevented from moving further, that is, being prevented from excessively moving. This structure can prevent the excessive movement of the movable member 31, while allowing the cross-sectional area of the first liquid passage 14 to be increased to improve the liquid passage recharge efficiency.

In the case of the modification illustrated in FIG. 12, (*c*), an engagement portion 57 is provided, which regulates the upward movement of the movable member 31 by coming in contact with the free end portion 32 of the movable member 31 as the movable member 31 is moved. The provision of this engagement portion 57 assures more reliable regulation of the free end portion 32, further improving the durability of the movable member.

Figure 13:
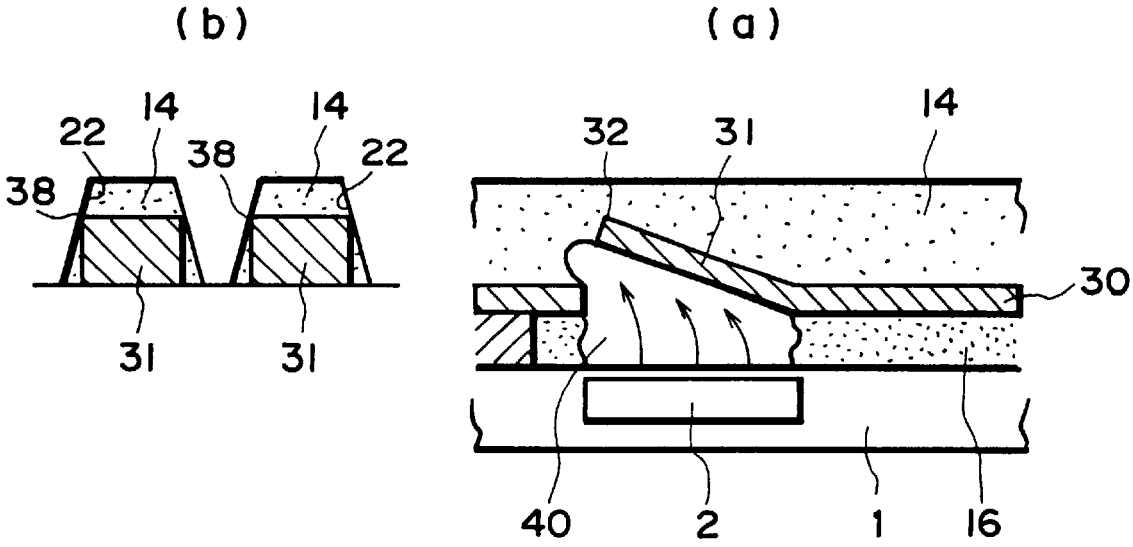
FIG. 13 is a sectional view of a major part of a liquid ejecting head according to a modified example of the fourth embodiment of the present invention.

FIG. 13, (*a*) is a longitudinal section of the liquid ejection heads in accordance with the present invention, and FIG. 13. (*b*) is a cross-section of the same, as seen from the ejection orifice side. In both drawings, the movable member has been moved. As is evident from FIG. 13.(*b*), the cross-section of the first liquid passage 14 is trapezoidal, therefore, the movement of the movable member 31 is regulated by the lateral walls of the liquid passage, at the points above which the distance between the lateral walls becomes less than the width of the free end portion of the movable member 31, preventing excessive upward movement.

Figure 14:
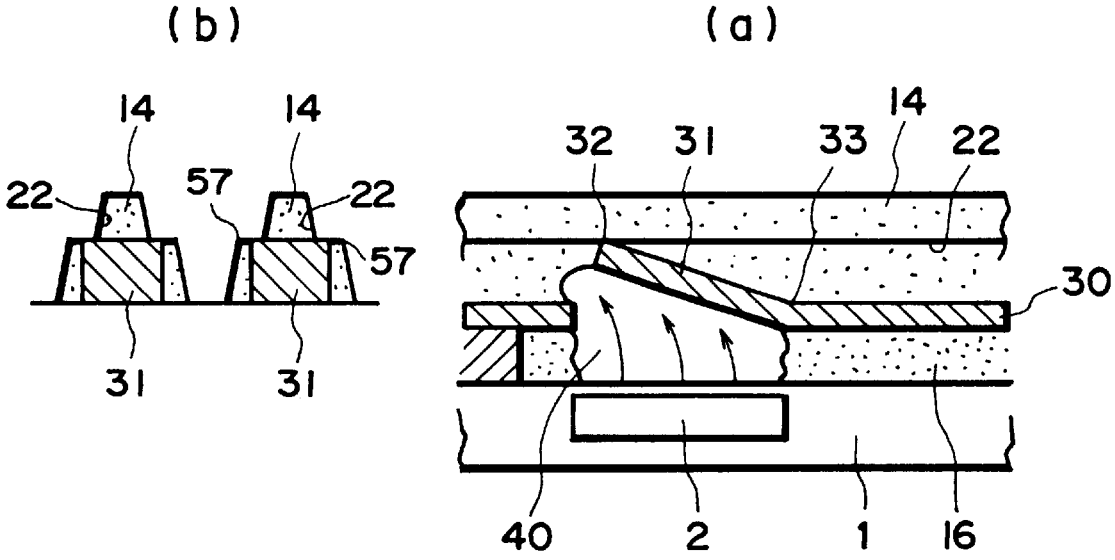
FIG. 14 is a sectional view of a major part of a liquid ejecting head according to a modified example of the fourth embodiment of the present invention.

FIG. 14, (*a*) is a longitudinal section of the liquid ejection heads in accordance with the present invention, and FIG. 14, (*b*) is a cross-section of the same, as seen from the election orifice side. In both drawings, the movable member has been moved. As is evident from FIG. 14, (*b*), a stepped portion 57 is provided on each lateral wall 22 of the first liquid passage 14. The presence of these stepped portions 22 renders the width of the first liquid passage 14 above these stepped portions 22 less than the width of the movable member, preventing the excessive movement of the movable member 31.

With the provision of the structure for preventing the excessive movement of the movable member, which was described above, the durability of the movable member can be drastically improved. In addition, even when the movable member displays relatively small rigidity, it can be prevented from being excessively flexed; therefore, the bubble is prevented from growing in directions (toward ceiling, or in the upstream direction) different from the direction of the election orifice, and also, the pressure from the bubble is prevented from being transmitted in directions other than the direction of the ejection orifice. As a result, it is possible to prevent the loss of ejection efficiency.

Embodiment 5

Figure 15:
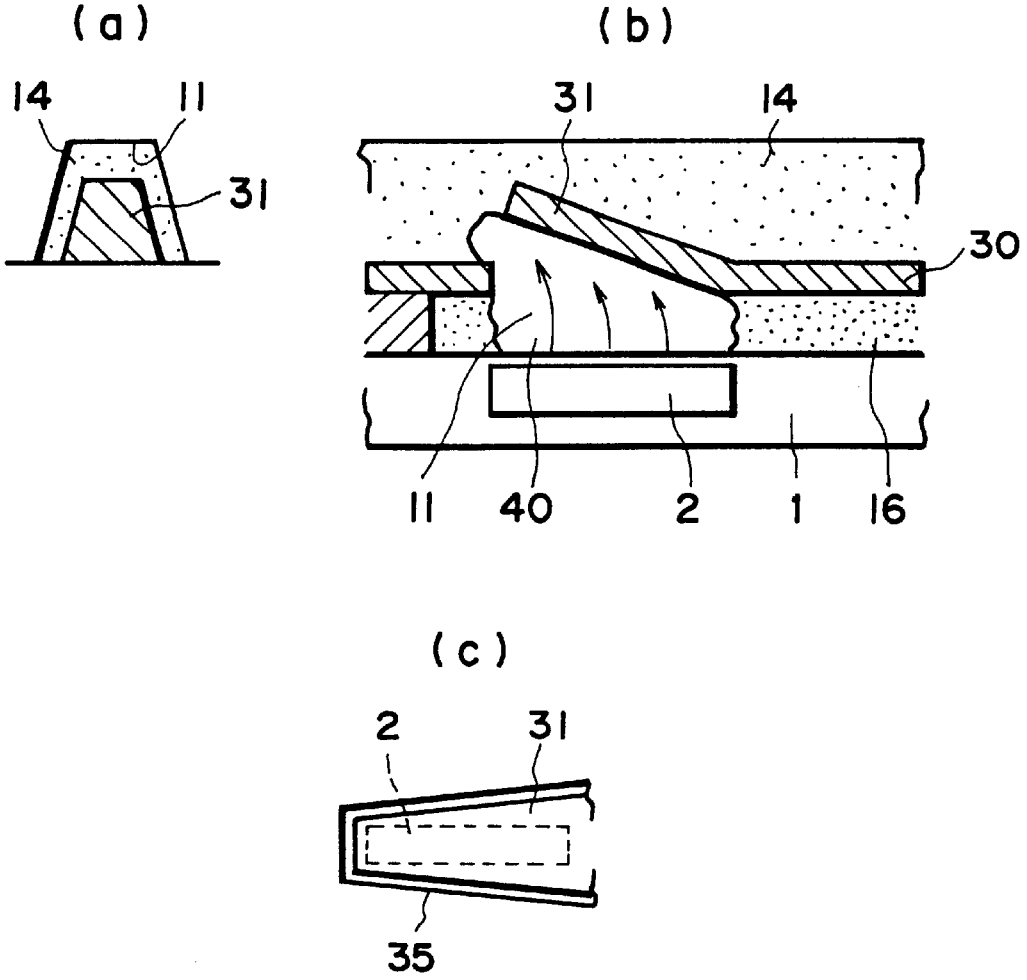
FIG. 15 is a sectional view of a major part of a liquid ejecting head according to a modified example of the fifth embodiment according to the present invention.

FIGS. 15, (*a*), 15, (*b*) and 15, (*c*) depict the fifth embodiment of the present invention. FIG. 15, (*a*) depicts the cross-section of the first liquid passage 14, as seen from the ejection orifice side, and also provides the projected view, as seen from the election orifice side, of the movable member 31 which has been moved into the first liquid passage 14 as illustrated in FIG. 15, (*b*). As is evident from FIG. 15, (*a*), the contour of the cross-section of the liquid passage 14 is similar to the contour of the projected view of the movable member 31, that is, both are trapezoidal. The trapezoidal contour of the projected view of the movable member 31 is realized by tapering the movable member 31 toward the free end thereof as shown in FIG. 15, (*c*).

With the provision of such a structure, the bubble generated by the heating member 2 is prevented as much as possible from escaping through the gaps formed between the free end edge and lateral edges of the movable member, and the corresponding walls. Consequently, the efficiency with which the bubble acts on the movable member can be improved while reducing the resistance to the upward movement of the movable member 31. As a result, the ejection efficiency is improved.

Figure 16:
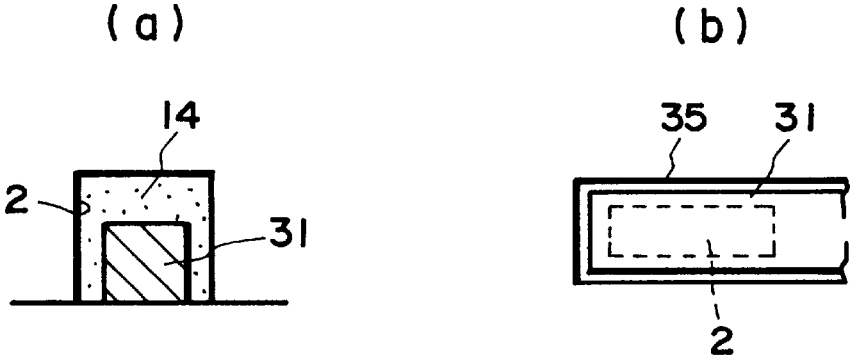
FIG. 16 shows a major part of the liquid ejecting head according to a fifth.

FIG. 16 depicts a modification of the fifth embodiment. In this modification, the contour of the cross-section of the liquid passage and the contour of the projected view of the movable member as seen from the ejection orifice side are similar in that they are both rectangular, or square. It should be noted here that the cross-sectional configuration of the liquid passage and the correspondent configuration of the movable member are not limited to those described above; for example, they may be triangular.

Other Embodiments

In the foregoing, the description has been made as to the major parts of the liquid ejecting head and the liquid ejecting method according to the embodiments of the present invention, the description will now be made as to further detailed embodiments usable with the foregoing embodiments. The following examples are usable with both of the single-flow-path type and two-flow-path type without specific statement.

Movable Member and Partition Wall

Figure 17:
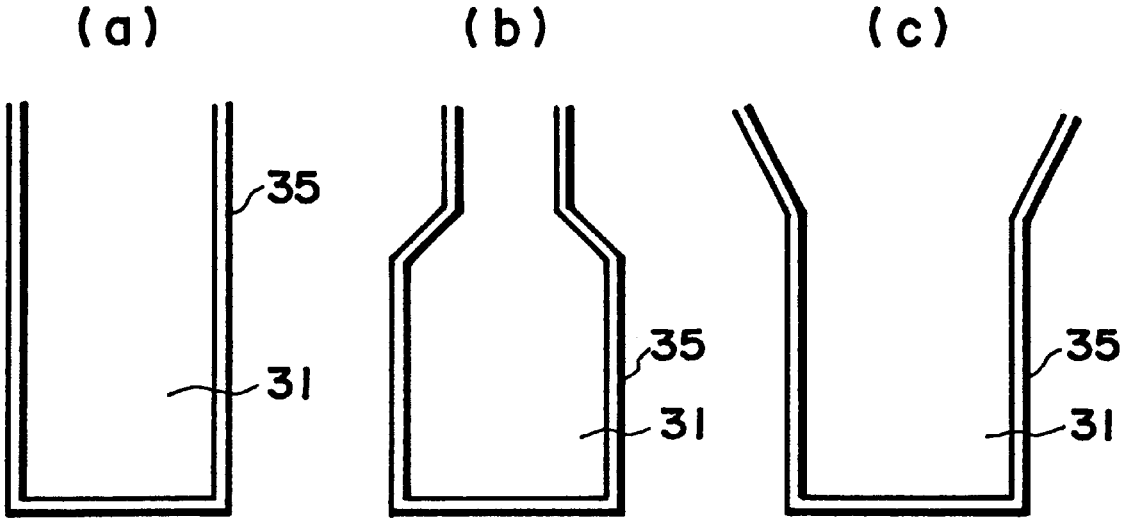
FIG. 17 depicts various configurations of the moving member.

FIG. 17 shows another example of the movable member 31, wherein reference numeral 35 designates a slit formed in the partition wall, and the slit is effective to provide the movable member 31. In FIG. 16, (*a*), the movable member has a rectangular configuration, and in (*b*), it is narrower in the fulcrum side to permit increased mobility of the movable member, and in (*c*), it has a wider fulcrum side to enhance the durability of the movable member. The configuration at the fulcrum side is desirable if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof, or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide. Polyethylene terephthalate, melamine resin material, phenolic resin, epoxy resin material, polybutadiene, polyurethane, polyetheretherketone, polyether sulfone, polyallylate, polyimide, poly-sulfone, liquid crustal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used, material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments, when the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the election liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower fro the bubble generation liquid and 20 CPS or lower for the election liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 13, 14 or the like) the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

Element Substrate

The description will be made as to a structure of the element substrate provided with the heat generating element for heating the liquid.

Figure 18:
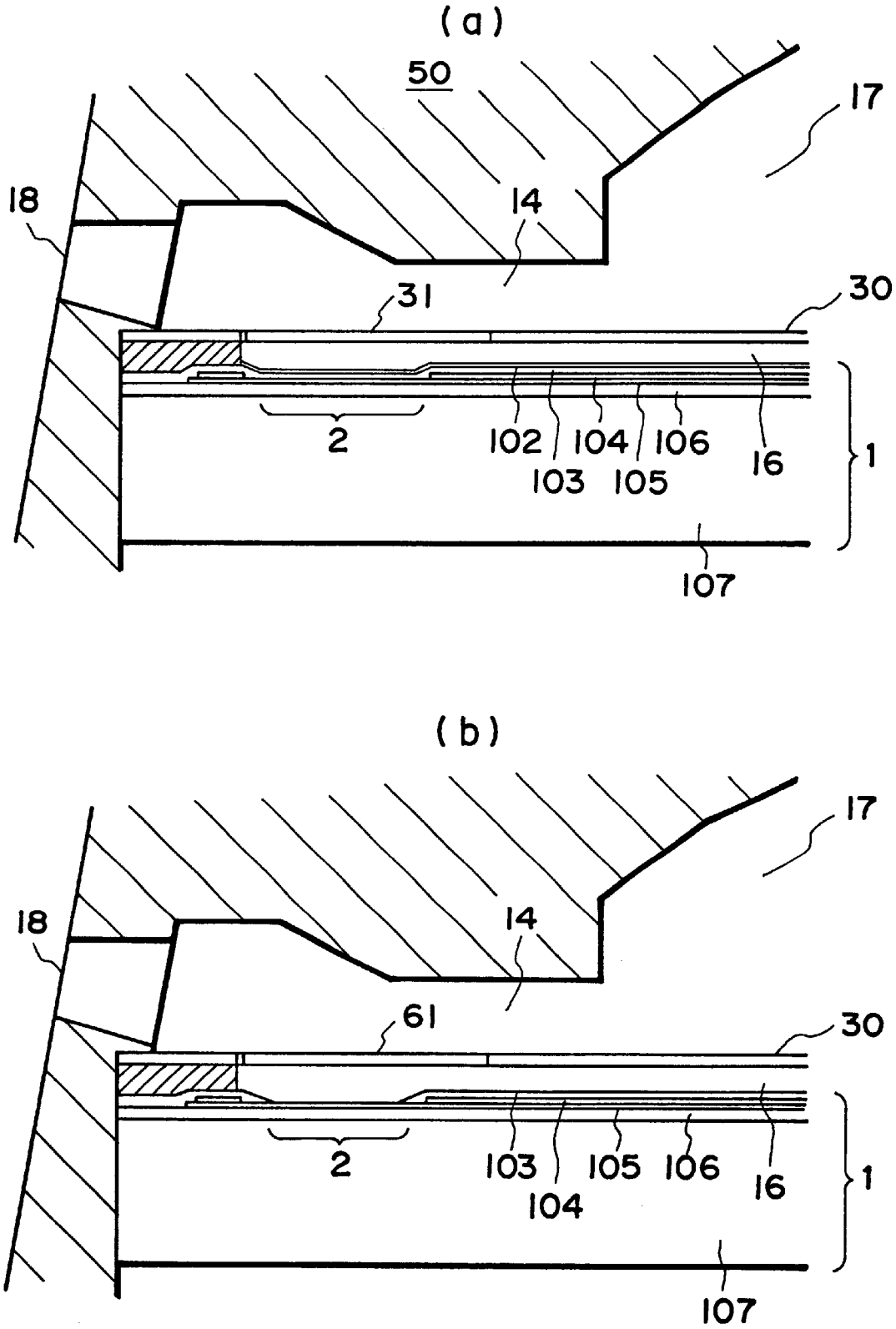
FIG. 18 is a longitudinal section of the liquid ejection head in accordance with the present invention.

FIG. 18 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated, therefore, metal material such as tantalum (Ta) or the like is used as the anti-cavitation layer.

Figure 19:
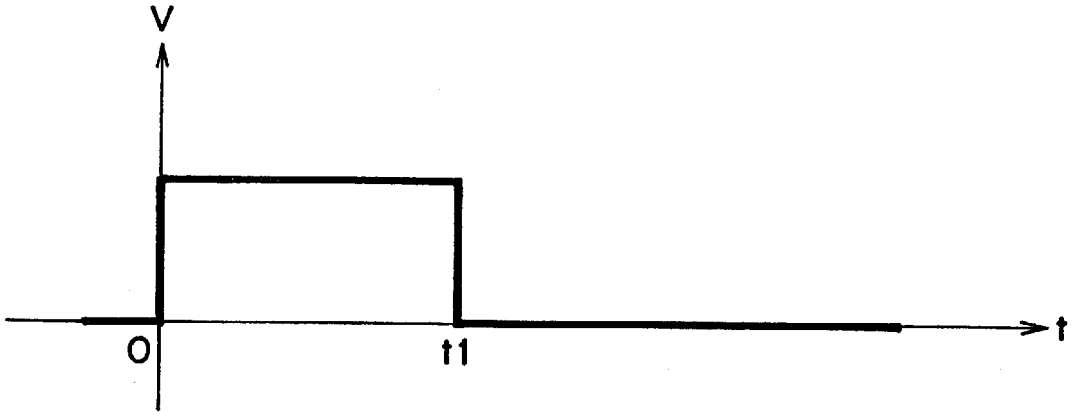
FIG. 19 is a diagram showing the form of the driving pulse.

The protection layer may be omitted depending on the combination of liquid, liquid flow path structure and resistance material, one of such examples is shown in FIG. 19, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

In order to eject the liquid by driving the heat generation portion of the electrothermal transducer on the above-described element substrate 1, the resistance layer 105 is supplied through the wiring electrode 104 with rectangular pulses as shown in FIG. 18 to cause instantaneous heat generation in the resistance layer 105 between the wiring electrode. In the case of the heads of the foregoing embodiments, the applied energy has a voltage of 24 V, a pulse width of 7 μsec, a current of 150 mA and a frequency of 6 kHz to drive the heat generating element, by which the liquid ink is ejected through the election outlet through the process described hereinbefore. However, the driving signal conditions are not limited to this. but may be any if the bubble generation liquid is properly capable of bubble generation.

Ejection Liquid and Bubble Generation Liquid

As described in the foregoing embodiment, according to the present invention, by the structure having the movable member described above, the liquid can be ejected at higher ejection force or ejection efficiency than the conventional liquid ejecting head.

When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2 cp | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly elected, and even 150 cps liquid was properly elected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: | |
| (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the election direction is expanded on the recording paper with the result of poor shot accuracy. Additionally, variation of election amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink election amount can be accomplished, thus improving the recorded image quality remarkably.

Structure of Twin Liquid Passage Head

Figure 20:
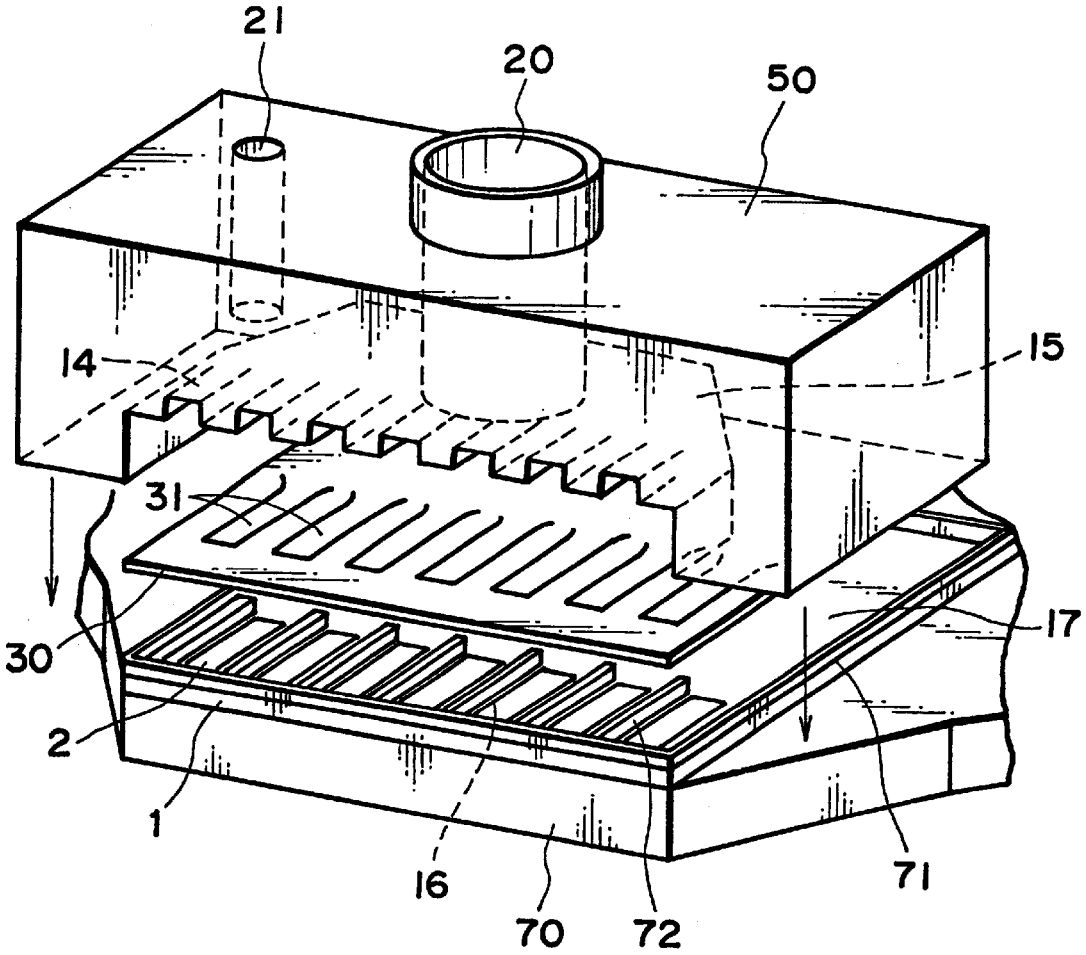
FIG. 20 is an exploded perspective view of the liquid ejection head in accordance with the present invention.

FIG. 20 is an exploded perspective view of the twin passage liquid ejection head in accordance with the present invention, and depicts its general structure.

The aforementioned element substrate 1 is disposed on a supporting member 70 of aluminum or the like. The wall 72 of the second liquid passage and the wall 71 of the second common liquid chamber 17 are disposed on this substrate 1. The partition wall 30, a part of which constitutes a moving member 31, is placed on top of them. On top of this partition wall 30, a grooved member 50 is disposed, which comprises: plural grooves constituting first liquid passages 14; a first common liquid chamber 15; a supply passage 20 for supplying the first common liquid chamber 15 with first liquid; and a supply passage 21 for supplying the second common liquid chamber 17 with second liquid.

Liquid Election Head Cartridge

The description will be made as to a liquid election head cartridge having a liquid ejecting head according to an embodiment of the present invention.

Figure 21:
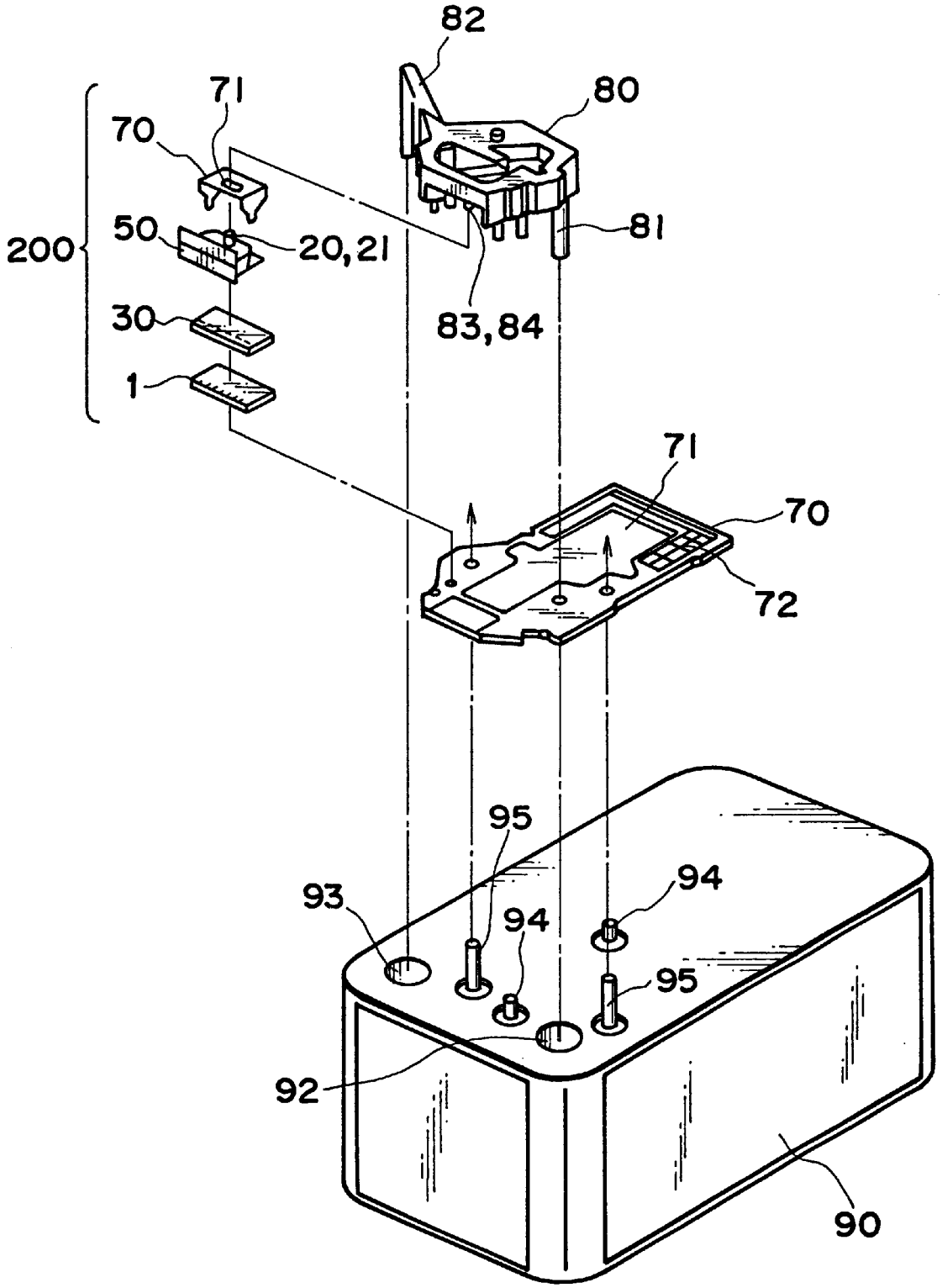
FIG. 21 is an exploded perspective view of a liquid ejection head cartridge.

FIG. 21 is a schematic exploded perspective view of a liquid election head cartridge including the above-described liquid ejecting head, and the liquid election head cartridge comprises generally a liquid electing head portion 200 and a liquid container 80.

The liquid electing head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an election flow path (unshown) for fluid communication with the election liquid is formed.

The confining spring 70 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the election liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the election liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the election liquid are different liquids, the liquids are supplied in good order. In the case that the election liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

Liquid Ejecting Device

Figure 22:
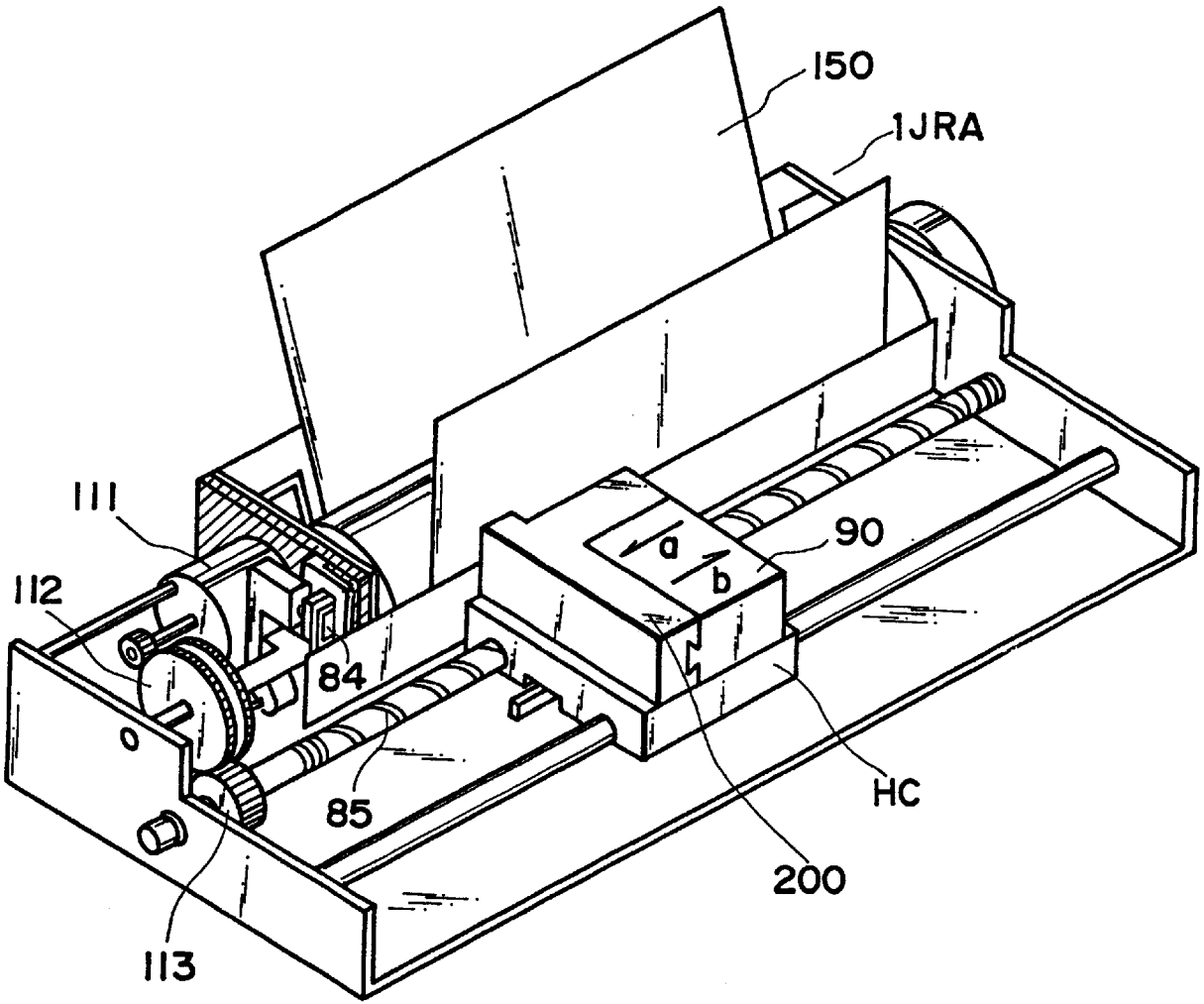
FIG. 22 is a perspective view of a liquid ejection apparatus, depicting the general structure thereof.

FIG. 22 is a schematic illustration of a liquid ejecting device used with the above-described liquid ejecting head. In this embodiment, the election liquid is ink, and the apparatus is an ink ejection recording apparatus, the liquid electing device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage., and carriage shaft 115 and so on. By the recording device and the liquid electing method using this recording device, good prints can be provided by electing the liquid to the various recording material.

Figure 23:
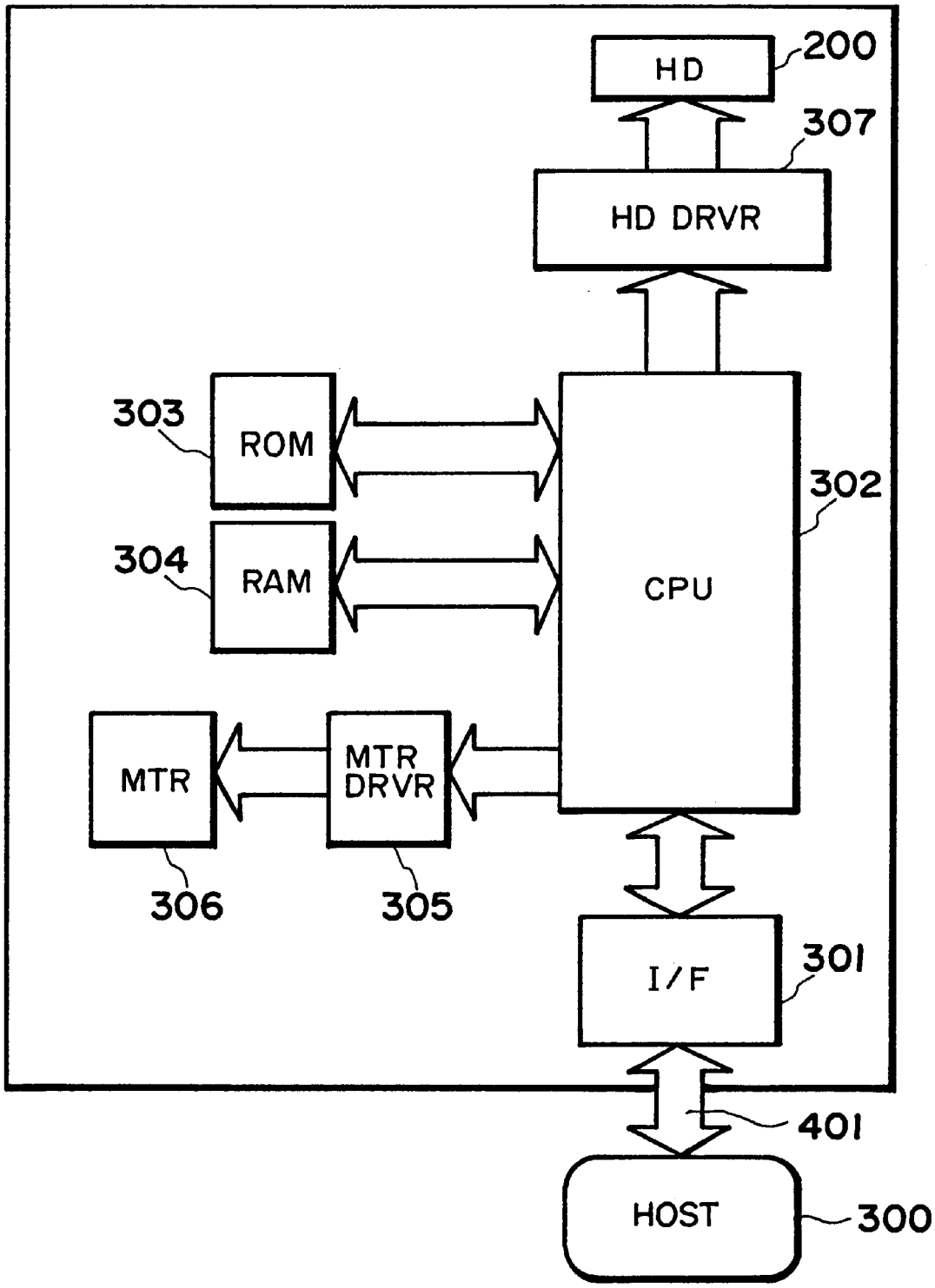
FIG. 23 is a block diagram of the apparatus illustrated in FIG. 22.

FIG. 23 is a block diagram for describing the general operation of an ink election recording apparatus which employs the liquid election method, and the liquid election head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet; the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Recording System

Next, an exemplary ink jet recording system will be described, which records images on recording medium, using, as the recording head, the liquid ejection head in accordance with the present invention.

Figure 24:
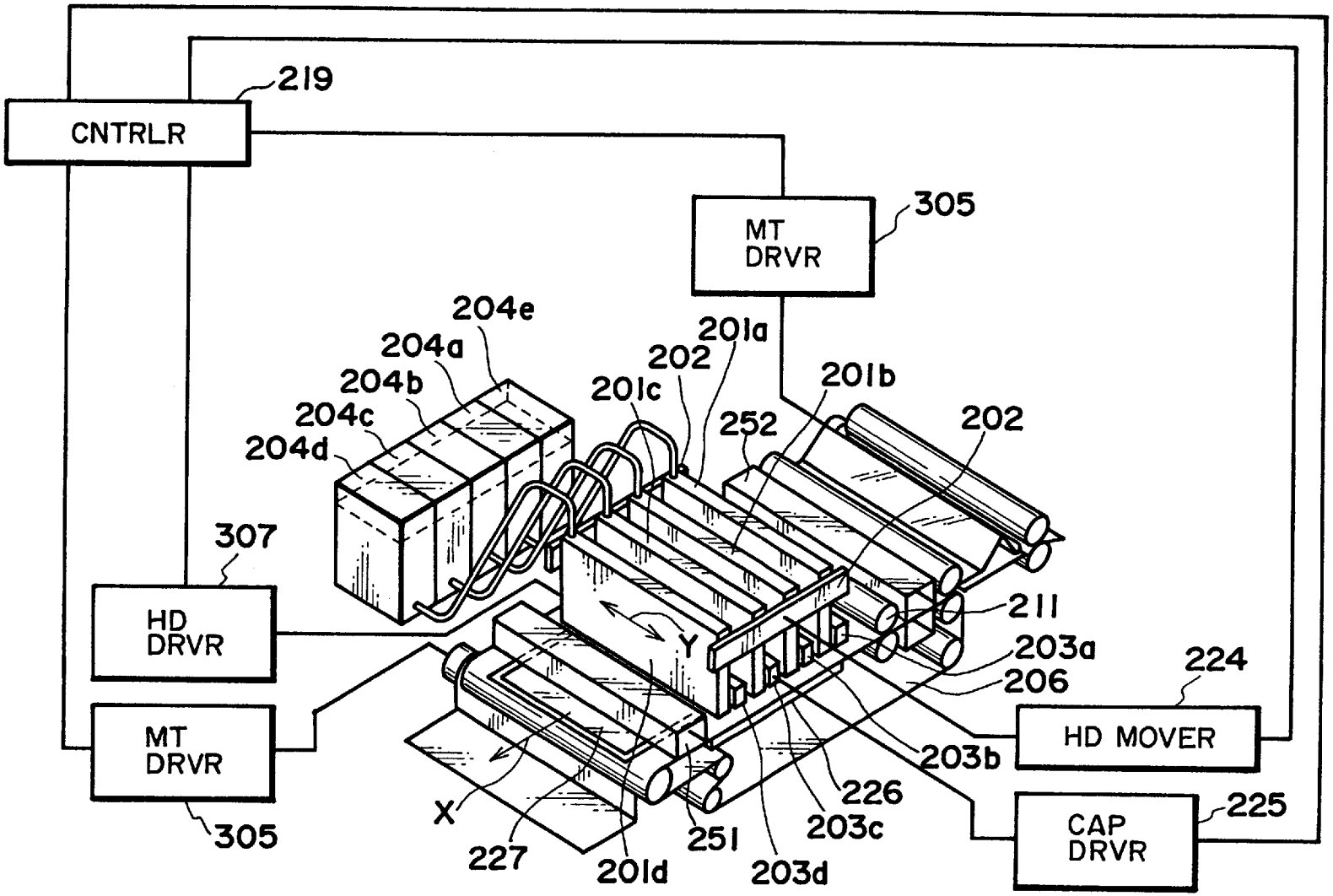
FIG. 24 is a perspective view of a liquid ejection recording system.

FIG. 24 is a schematic perspective view of an ink jet recording system employing the aforementioned liquid election head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a,* 204*b,* 205*c* or 204*d.* A reference numeral 204*e* designates a bubble generation liquid container from which the bubble generation liquid is delivered to each head.

Below each head, a head cap 203*a,* 203*b,* 203*c* or 203*d* is disposed, which contains an ink absorbing member composed of sponge or the like. They cover the election orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity, the dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

Head Kit

Figure 25:
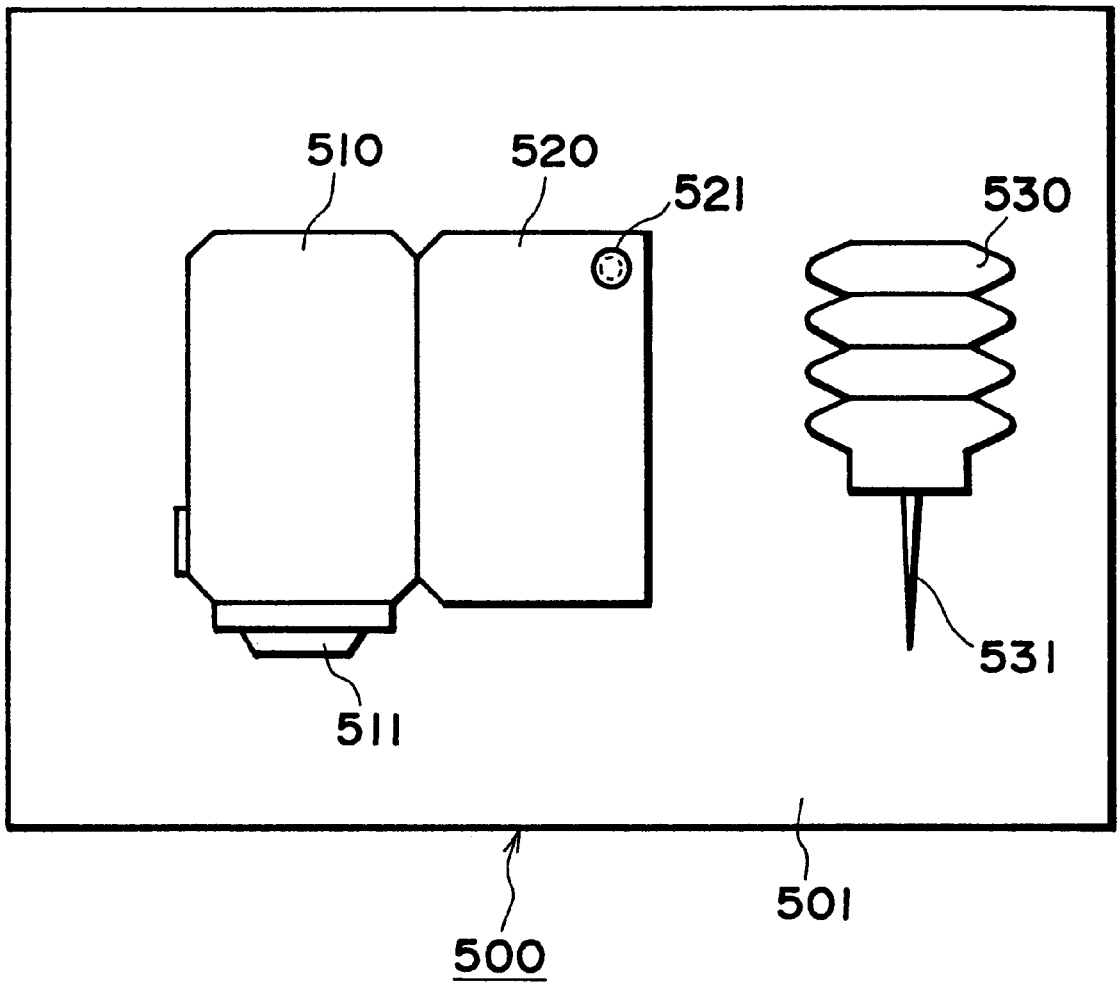
FIG. 25 is a schematic drawing of a head kit.

Hereinafter, a head kit will be described, which comprises the liquid ejection head in accordance with the present invention. FIG. 25 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid election head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 28 illustrates only the ink filling means for filling the printing ink into the ink container, the head kit may contain means for filling the bubble generation liquid into the bubble generation liquid container, in addition to the printing ink refilling means.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting head for ejecting liquid by generation of a bubble, comprising:

an ejection outlet for ejecting the liquid;

a liquid flow path in fluid communication with said ejection outlet;

a bubble generation region for generating the bubble in the liquid in said liquid flow path;

a movable member having side edges extending along side surfaces of said liquid flow path and having a fulcrum and a free end located downstream of said fulcrum, said free end being disposed facing said bubble generation region, and said movable member being caused to move by pressure produced by the generation of the bubble; and a stopper piece, provided in said liquid flow path opposite a movable portion of said movable member, for limiting motion of said movable member caused by the pressure.

2. A head according to claim 1, further comprising a heat generating element for generating heat to be utilized to generate the bubble in said bubble generating region, wherein said heat generating element and said movable member face each other with said bubble generating region therebetween, and said fulcrum is disposed upstream of an area center of said heat generating element, and said free end is disposed downstream of the area center.

3. A liquid ejecting head according to claim 1, further comprising a heat generating element for generating heat to be utilized to generate the bubble in said bubble generating region, wherein said heat generating element is provided with a resistance layer and a pair of electrodes connected to said resistance layer, and a heat generating surface is formed between said electrodes.

4. A liquid ejecting head according to claim 3, wherein said heat generating element further comprises a protection layer for protecting said resistance layer and said pair of electrodes.

5. A liquid ejecting head according to claim 1, wherein said liquid flow path has an upper surface and said upper surface is curved.

6. A liquid ejecting head according to claim 1, wherein said liquid flow path has an upper surface and said upper surface is slanted.

7. A liquid ejecting head according to claim 1, wherein said liquid flow path has an upper surface and said upper surface is stepped.

8. A liquid ejecting head according to claim 1, wherein said liquid flow path has an upper surface and said upper surface has a projection extending toward said movable member, said projection serving to limit motion of said movable member toward said upper surface.

9. A liquid ejecting head according to claim 1, wherein said liquid flow path has a trapezoidal cross-section having inwardly narrowing side walls such that said liquid flow path narrows moving away from said movable member, said trapezoidal cross-section being dimensioned such that motion of said movable member is limited when said movable member contacts said inwardly narrowing side walls.

10. A liquid ejecting head according to claim 1, wherein said stopper piece comprises at least one shoulder portion projecting inwardly into said liquid flow path and being dimensioned and disposed so as to limit motion of said movable member in a direction toward said shoulder portion.

11. A liquid ejecting head according to claim 1, wherein both a cross-section of said liquid flow path and a cross-section of said movable member are trapezoidal.

12. A liquid ejecting head according to claim 1, wherein both a cross-section of said liquid flow path and a cross-section of said movable member are rectangular.

13. A liquid ejecting head for ejecting liquid by generation of a bubble, comprising:

an ejection outlet for ejecting the liquid;

a liquid flow path in fluid communication with said ejection outlet;

a bubble generation region for generating the bubble in the liquid in said liquid flow path; and a movable member having side edges extending along side surfaces of said liquid flow path and having a fulcrum and a free end located downstream of said fulcrum, said free end being disposed facing said bubble generation region, and said movable member being caused to move by pressure produced by the generation of the bubble, wherein a portion of said liquid flow path, opposite a movable portion of said movable member, stops movement of said movable portion of said movable member caused by the pressure.

* * * * *

UNITED STATES PATENT AND TRADEMARK OFFICE

CERTIFICATE OF CORRECTION

PATENT NO. : 6,595,626 B2
DATED : July 22, 2003
INVENTOR(S) : Kiyomitsu Kudo et al.

It is certified that error appears in the above-identified patent and that said Letters Patent is hereby corrected as shown below:

Column 1,
Line 52, "With such" should read -- Such --; and
Line 58, "let" should read -- jet --.

Column 3,
Line 26, "electing" should read --ejecting--.

Column 4,
Lines 14, 19 and 22, "election" should read -- ejection --;
Lines 23 and 67, "elect" should read -- eject --;
Lines 27, 44 and 46, "electing" should read -- ejecting --;
Lines 29, 34, 37 and 66, "election" should read -- ejection --; and
Line 55, "electing" (both occurrences) should read -- ejecting --.

Column 5,
Line 5, "election" should read -- ejection --;
Line 8, "election" should read -- ejection -- and "electing" should read -- ejecting --;
Line 14, "the liquid," should read -- of the liquid --;
Lines 19, 20 and 29, "electing" should read -- ejecting --;
Line 33, "elected" should read -- ejected --; and
Lines 41, 43 and 47, "electing" should read -- ejecting --.

Column 6,
Line 7, "ejection" should read -- ejected --;
Line 15, "election" should read -- ejection --; and
Line 54, "edgiest" should read -- against --.

Column 7,
Line 5, "example" should read -- an example --.

Column 8,
Line 9, "the-liquid" should read -- the liquid --;
Line 19, "elect" should read -- eject --; and
Lines 26, 39 and 66, "election" should read -- ejection --.

UNITED STATES PATENT AND TRADEMARK OFFICE

CERTIFICATE OF CORRECTION

PATENT NO. : 6,595,626 B2
DATED : July 22, 2003
INVENTOR(S) : Kiyomitsu Kudo et al.

It is certified that error appears in the above-identified patent and that said Letters Patent is hereby corrected as shown below:

Column 9,
Lines 5 and 35, "election" should read -- ejection --;
Line 26, "of the is normal" should read -- is normal --;
Line 33, "election" (both occurrences) should read -- ejection --; and
Line 59, "vet" should read -- yet --.

Column 10,
Line 21, "by" should read -- and by --.

Column 11,
Lines 18 and 49, "election" should read -- ejection --.

Column 12,
Line 64, "election" should read -- ejection --.

Column 13,
Line 52, "that" should read -- than --; and
Line 53, "election" should read -- ejection --.

Column 15,
Lines 35 and 36, "election" should read -- ejection --; and
Lines 38 and 64, "election" should read -- ejection --.

Column 16,
Line 9, "election" should read -- ejection --.

Column 17,
Lines 24 and 41, "election" should read -- ejection --; and
Line 50, "election" should read -- ejection --.

Column 19,
Line 37, "fro" should read -- for --.

Column 20,
Line 63, "election" should read -- ejection --.

UNITED STATES PATENT AND TRADEMARK OFFICE

CERTIFICATE OF CORRECTION

PATENT NO. : 6,595,626 B2
DATED : July 22, 2003
INVENTOR(S) : Kiyomitsu Kudo et al.

It is certified that error appears in the above-identified patent and that said Letters Patent is hereby corrected as shown below:

Column 21,
Line 65, "elected," should read -- ejected, --; and
Line 66, "elected" should read -- ejected --.

Column 22,
Lines 28, 30, 35 55, 59 and 60, "election" should read -- ejection --; and
Lines 61 and 63, "electing" should read -- ejecting --.

Column 23,
Lines 5 and 6, "election" should read -- ejection --;
Lines 18 and 39, "election" should read -- ejection --;
Line 30, "election" should read -- ejection -- and "supply" should read -- 70 --;
Lines 41 and 52, "election" should read -- ejection --; and
Line 54, "electing" should read -- ejecting --.

Column 24,
Line 3, "carriage.," should read -- carriage, --;
Lines 4 and 6, "electing" should read -- ejecting --;
Line 8, election" should read -- ejection --;
Line 9, "election" (both occurrences) should read -- ejecting --;
Line 22, "sheet;" should read -- sheet, --;
Line 32, "listed;" should read -- listed: --; and
Line 61, "elec-" should read -- ejec- --.

Column 25,
Line 15, "election" should read -- ejection --.

UNITED STATES PATENT AND TRADEMARK OFFICE

CERTIFICATE OF CORRECTION

PATENT NO. : 6,595,626 B2
DATED : July 22, 2003
INVENTOR(S) : Kiyomitsu Kudo et al.

It is certified that error appears in the above-identified patent and that said Letters Patent is hereby corrected as shown below:

Column 26,
Line 15, "election" should read -- ejection --.

Signed and Sealed this

Sixth Day of January, 2004

JAMES E. ROGAN
*Director of the United States Patent and Trademark Office*